US011047615B1

(12) United States Patent
Sikir et al.

(10) Patent No.: US 11,047,615 B1
(45) Date of Patent: Jun. 29, 2021

(54) FLIP UP COMPARTMENT FLOOR

(71) Applicant: Sub-Zero Group, Inc., Madison, WI (US)

(72) Inventors: Paul V. Sikir, Middleton, WI (US); Philip Francis Hottmann, Verona, WI (US)

(73) Assignee: SUB-ZERO GROUP, INC., Madison, WI (US)

( * ) Notice: Subject to any disclaimer, the term of this patent is extended or adjusted under 35 U.S.C. 154(b) by 0 days.

(21) Appl. No.: 17/141,292

(22) Filed: Jan. 5, 2021

(51) Int. Cl.
*F25D 23/04* (2006.01)
*F25D 25/02* (2006.01)

(52) U.S. Cl.
CPC ..... *F25D 23/04* (2013.01); *F25D 25/022* (2013.01); *F25D 25/027* (2013.01); *F25D 2325/021* (2013.01); *F25D 2331/803* (2013.01); *F25D 2500/02* (2013.01)

(58) Field of Classification Search
CPC ..... F25D 23/04; F25D 25/02; F25D 25/022; F25D 25/027; F25D 2331/803; F25D 2500/02; F25D 2325/021
See application file for complete search history.

(56) References Cited

U.S. PATENT DOCUMENTS 2,062,360 A 12/1936 Goulooze
2,955,006 A 10/1960 White
5,445,452 A 8/1995 Kauffman et al.
5,813,741 A 9/1998 Fish et al.
8,336,976 B2 * 12/2012 Lee ..... F25D 23/04 312/405.1
8,640,482 B2 * 2/2014 Lim ..... F25D 25/02 62/340
8,814,287 B2 8/2014 Jin et al.
9,074,807 B2 7/2015 Borgonovo et al.
2009/0033191 A1 2/2009 Kim
2010/0109498 A1 5/2010 Ramm et al.

FOREIGN PATENT DOCUMENTS

CN 203310198 U * 11/2013 ..... F25D 23/04
CN 102494496 3/2014
CN 203704514 U * 7/2014 ..... F25D 23/04
DE 8803320 U1 6/1988
(Continued)

OTHER PUBLICATIONS

LG Spec Sheet, LDC24370, A Smartly-Designed Refrigerator, 2015 LG Electronics USA, Inc.

*Primary Examiner* — Andrew M Roersma
(74) *Attorney, Agent, or Firm* — Bell & Manning, LLC

(57) ABSTRACT

A shelf includes a floor plate, a cam plate, and a first pin joint plate. The cam plate extends away from an upper surface of the floor plate. A top edge of the cam plate is opposite a bottom edge of the cam plate that is mounted to the upper surface and has a concave shape that curves inward toward the upper surface. The first pin joint plate is mounted to the floor plate to extend away from a lower surface of the floor plate. The first pin joint plate is configured to mate with a second pin joint plate mounted to a first wall. The top edge of the cam plate is positioned to abut a tab mounted to the second wall when the floor plate is rotated toward the second wall. The upper surface faces the second wall when the floor plate is rotated toward the second wall.

20 Claims, 19 Drawing Sheets

(56) References Cited

FOREIGN PATENT DOCUMENTS

| | | | | | |
|---|---|---|---|---|---|
| DE | 102011077820 | A1 * | 12/2012 | ..... | F25D 23/04 |
| DE | 102018215474 | A1 * | 3/2020 | ..... | F25D 23/04 |
| EP | 0937223 | | 2/2002 | | |
| EP | 2131126 | | 5/2009 | | |
| EP | 2977694 | | 1/2016 | | |

* cited by examiner

FLIP UP COMPARTMENT FLOOR

BACKGROUND

Refrigerators include various storage containers such as shelfs, drawers, and compartments that are arranged in the interior or on a door. Despite being able to adjust the location of some of the storage containers, large items sometimes still do not fit well in a desired location.

SUMMARY

In an example embodiment, a shelf is provided. The shelf includes, but is not limited to, a floor plate, a cam plate, and a first pin joint plate. The floor plate includes, but is not limited to, a front edge, a right edge, a left edge, and a back edge. The back edge is closest to a second wall when the floor plate is mounted adjacent the second wall. The right edge extends between the front edge and the back edge. The left edge extends between the front edge and the back edge. The cam plate is mounted to the floor plate to extend away from an upper surface of the floor plate. A top edge of the cam plate is opposite a bottom edge of the cam plate that is mounted to the upper surface of the floor plate. The top edge has a concave shape that curves inward toward the upper surface of the floor plate. The first pin joint plate is mounted to the floor plate to extend away from a lower surface of the floor plate. The first pin joint plate is configured to mate with a second pin joint plate mounted to a first wall when the floor plate is mounted to the first wall. The top edge of the cam plate is positioned to abut a tab mounted to the second wall when the floor plate is mounted adjacent the second wall and rotated toward the second wall. The upper surface of the floor plate faces the second wall when the floor plate is rotated toward the second wall.

In another example embodiment, a door is provided. The door includes, but is not limited to, an interior door plate, a right mounting ladder mounted to the interior door plate, a left mounting ladder mounted to the interior door plate, a shelf mounted to the right mounting ladder and to the left mounting ladder, and a rotatable shelf mounted to the right mounting ladder and to the left mounting ladder above the shelf.

In yet another example embodiment, a refrigerator is provided. The refrigerator includes, but is not limited to, a refrigeration system, a compartment, a right mounting ladder, a left mounting ladder, a shelf mounted to the right mounting ladder and to the left mounting ladder, and a rotatable shelf mounted to the right mounting ladder and to the left mounting ladder above the shelf. The compartment includes, but is not limited to, a plurality of walls and a door configured to provide access to an enclosed space defined by the plurality of walls and the door. The door is configured to provide access to an enclosed space defined by the plurality of walls and the door. The right mounting ladder and the left mounting ladder are mounted to the door.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
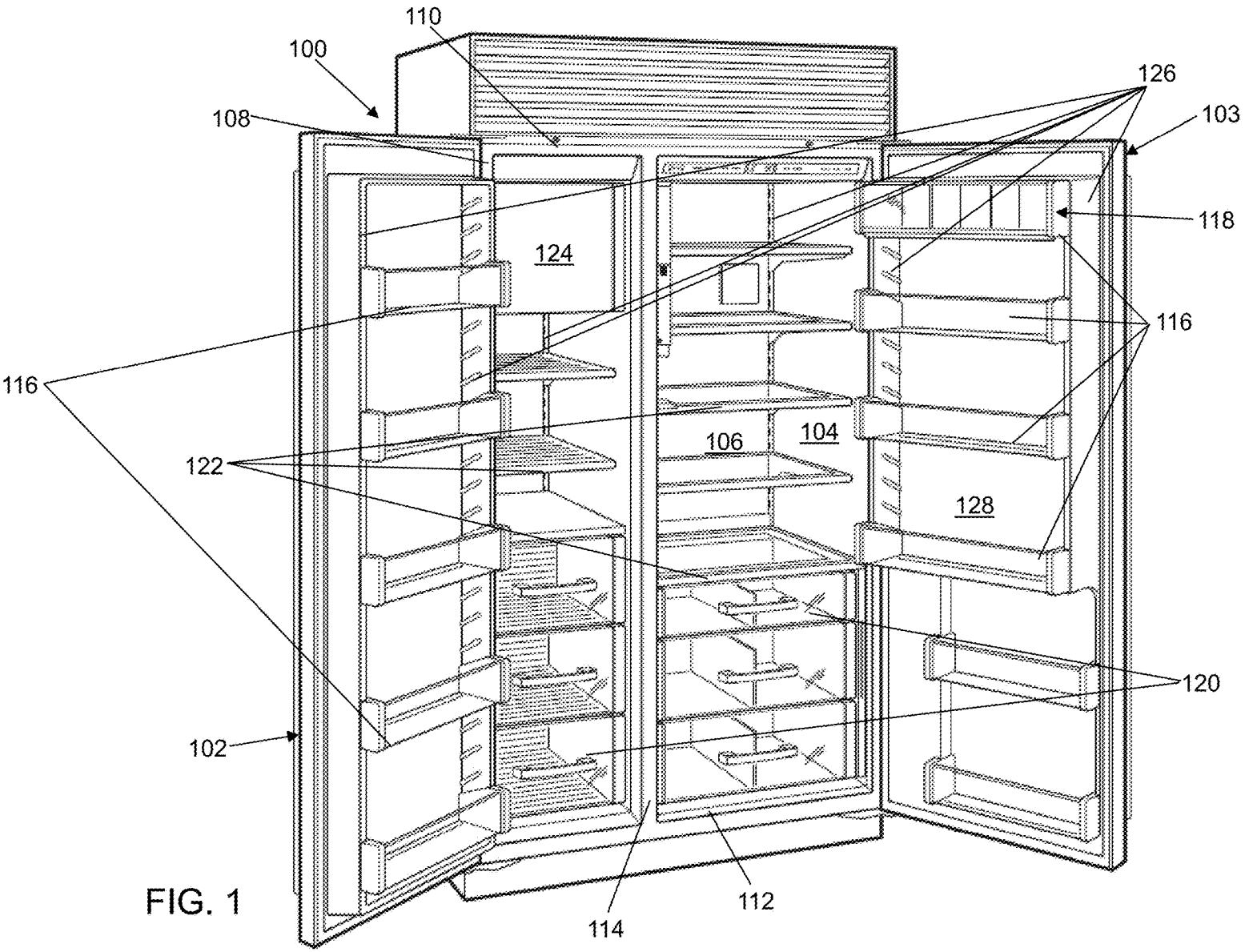
FIG. 1 depicts a left, front perspective view of an open refrigerator in accordance with an illustrative embodiment.

Referring to FIG. 1, a left, front, perspective view of a refrigerator 100 is shown in accordance with an illustrative embodiment. Refrigerator 100 may include a plurality of compartments or cooling zones. Refrigerator 100 may include a freezer compartment door 102, a refrigerator compartment door 103, a right side wall 104, a back wall 106, a left side wall 108, a top wall 110, a bottom wall 112, and a divider wall 114. In the illustrative embodiment, freezer compartment door 102 is rotatably mounted to top wall 110 and bottom wall 112 adjacent left side wall 108 using two hinges, and refrigerator compartment door 103 is rotatably mounted to top wall 110 and bottom wall 112 adjacent right side wall 104 using another two hinges. In alternative embodiments, freezer compartment door 102 and/or refrigerator compartment door 103 may be rotatably mounted to different walls of refrigerator 100 using a fewer or a greater number of hinges.

Freezer compartment door 102 provides access to a freezer compartment defined by top wall 110, left side wall 108, bottom wall 112, back wall 106, divider wall 114, and freezer compartment door 102 when freezer compartment door 102 is in a closed position. Refrigerator compartment door 103 provides access to a refrigerated compartment defined by top wall 110, right side wall 104, bottom wall 112, back wall 106, divider wall 114, and refrigerator compartment door 103 when refrigerator compartment door 103 is in a closed position.

Divider wall 114 separates the freezer compartment from the refrigerator compartment. In the illustrative embodiment, divider wall 114 extends vertically between top wall 110 and bottom wall 112. Of course, in alternative embodiments, divider wall 114 may extend horizontally to separate the two compartments with the freezer compartment either above or below the refrigerated compartment. Additionally, in alternative embodiments, the locations of the freezer compartment and the refrigerated compartment may be reversed. Further, refrigerator 100 may include a greater or a fewer number of compartments in various arrangements horizontally or vertically with respect to each other.

Though shown in the illustrative embodiment as forming a generally rectangular shaped enclosure, refrigerator 100 may form any shaped enclosure including other polygons as well as circular or elliptical enclosures. As a result, freezer compartment door 102, refrigerator compartment door 103, and the walls forming refrigerator 100 may have any shape including other polygons as well as circular or elliptical shapes.

Various storage devices may be housed within the enclosed space(s) of refrigerator 100. For example, zero or more drawers 120, shelves 122, or other receptacles may be mounted within the freezer compartment and the refrigerator compartment. An ice maker/dispenser 124 may be mounted within the freezer space to make and store ice. Zero or more door shelves 116 may be mounted to either or both of freezer compartment door 102 and refrigerator compartment door 103.

The storage devices may mount to various walls of refrigerator 100, to freezer compartment door 102, and/or to refrigerator compartment door 103 using one or more ladders 126 that are mounted to a wall of refrigerator 100, a wall of freezer compartment door 102, or a wall of refrigerator compartment door 103. For example, a right mounting ladder and a left mounting ladder of the one or more ladders 126 may be mounted to an interior door plate 128 of refrigerator compartment door 103. The one or more ladders 126 may be configured so that a mounting mechanism of a respective drawer, shelf, or other receptacle is attached to a rung of the ladder or between a pair of ladder rungs as understood by a person of skill in the art. For example, the mounting mechanism may include a hook that is mounted to the storage device and over a rung of the ladder or between a pair of ladder rungs to position the storage device within the enclosed space, on freezer compartment door 102, or on refrigerator compartment door 103. As another example, the mounting mechanism may include a pin that is mounted to the storage device and inserted in a rung of the ladder or between a pair of ladder rungs to position the storage device within the enclosed space, on freezer compartment door 102, or on refrigerator compartment door 103. As yet another example, the mounting mechanism may include an aperture that is mounted to the storage device and to a pin mounted as a rung of the ladder to position the storage device within the enclosed space, on freezer compartment door 102, or on refrigerator compartment door 103. Other mounting mechanisms may be used such as adhesive, soldering, etc. Zero or more of the storage devices may be mountable to different ladder rungs to change a position of the storage container within the enclosed space, on freezer compartment door 102, or on refrigerator compartment door 103.

A first shelf 118 is an illustrative shelf that can be mounted to either or both of freezer compartment door 102 and refrigerator compartment door 103. First shelf 118 further may be mounted to one of the plurality of walls of refrigerator 100 in alternative embodiments. For example, first shelf 118 may be mounted to right side wall 104, back wall 106, left side wall 108, or divider wall 114.

As understood by a person of skill in the art, the walls that form refrigerator 100 include insulation to assist in maintenance of the desired temperature in the freezer and refrigerator compartments. Electrical wiring and various conduits may further be located in the walls.

A temperature of one or more refrigerated compartments of refrigerator 100 is maintained at an adequate temperature to preserve fresh food using a refrigeration system (not shown) as understood by a person of skill in the art, and a temperature of one or more freezer compartments is maintained at an adequate temperature to maintain food stored therein in a frozen state using a second refrigeration system (not shown) as understood by a person of skill in the art.

A refrigerator controller (not shown) may control a flow of refrigerant through each refrigeration system of refrigerator 100. Refrigerator 100 may include one or more refrigeration systems. Refrigeration system components such as a compressor, a condenser, an evaporator, a dryer, etc. may be mounted to various walls of refrigerator 100 either within the walls, on an exterior of the walls relative to refrigerator 100, and/or on an interior of the walls relative to refrigerator 100.

Use of directional terms, such as top, bottom, right, left, front, back, etc. are merely intended to facilitate reference to the various surfaces and elements of the described structures relative to the orientations shown in the drawings and are not intended to be limiting in any manner. For consistency, the components of refrigerator 100 are labeled such that freezer compartment door 102 and refrigerator compartment door 103 define a front of refrigerator 100. However, the components of first shelf 118 are labeled assuming refrigerator compartment door 103 is open as shown in FIG. 1 and a user is positioned looking at first shelf 118.

Figure 2A:
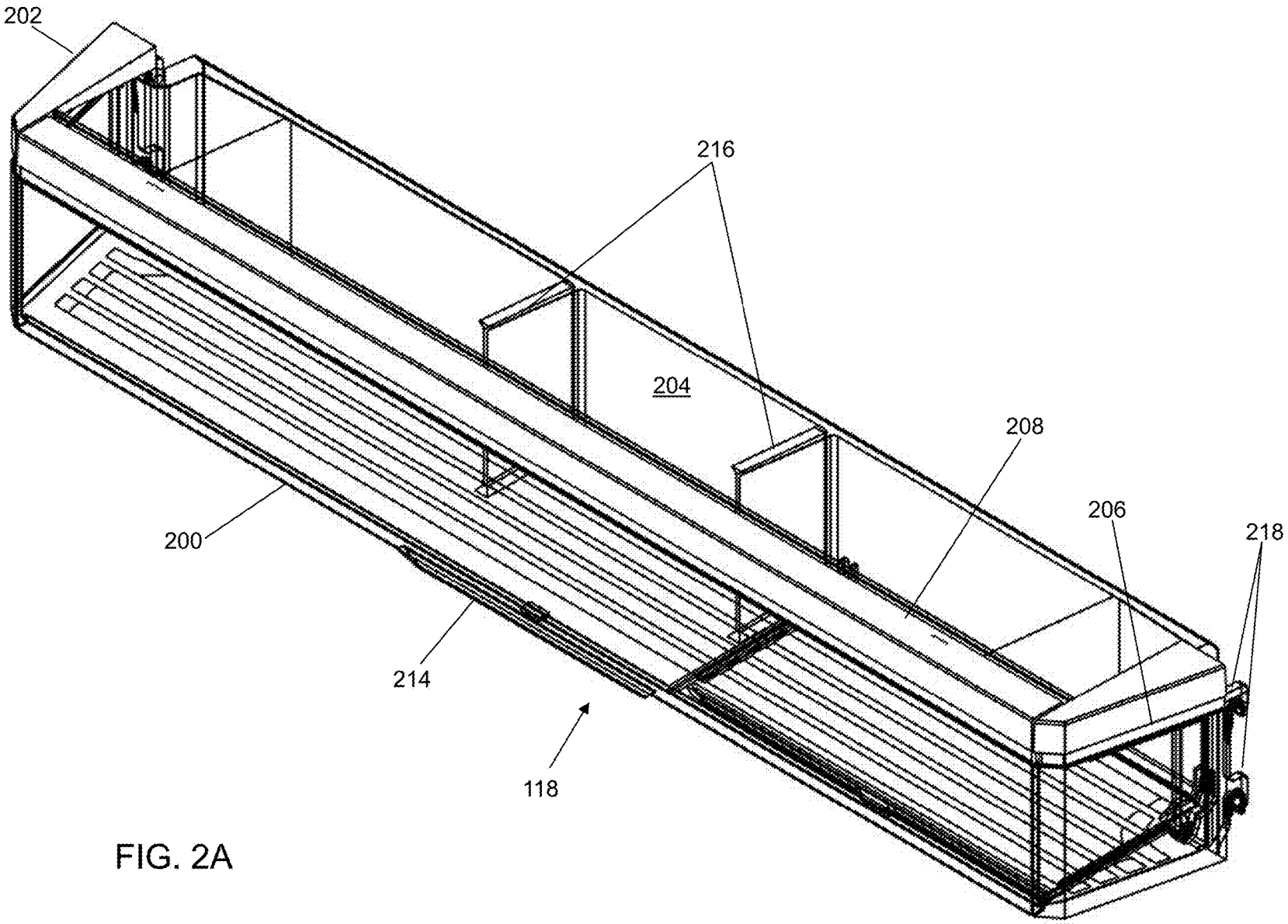
FIG. 2A depicts a top, right, front perspective view of a shelf of the refrigerator of FIG. 1 in accordance with an illustrative embodiment.

Referring to FIG. 2A, first shelf 118 is shown in accordance with an illustrative embodiment. First shelf 118 may include a shelf door 200, a shelf left side wall 202, a shelf back wall 204, a shelf right side wall 206, a shelf top wall 208, a shelf bottom wall 210, and a rotatable shelf bottom wall 212. A door handle 214 may be formed in shelf door 200 to facilitate opening and closing of shelf door 200. In the illustrative embodiment, shelf door 200 is mounted for rotation in a clockwise direction relative to a top, front edge where shelf door 200 mounts adjacent shelf top wall 208 and between shelf left side wall 202 and shelf right side wall 206. In alternative embodiments, first shelf 118 may not include shelf door 200, may include a partial front wall to maintain items placed on first shelf 118 on first shelf 118, or may not include a front wall at all.

First shelf 118 further may include zero or more divider walls 216 that extend from shelf back wall 204 toward shelf door 200. The one or more divider walls 216 define separate storage areas along shelf bottom wall 210 and rotatable shelf bottom wall 212.

First shelf 118 further may include a right mounting mechanism 218 and a left mounting mechanism 220. In the illustrative embodiment, right mounting mechanism 218 and left mounting mechanism 220 are hooks that protrude outward away from shelf right side wall 206 and shelf left side wall 202, respectively, or from shelf back wall 204. Right mounting mechanism 218 and left mounting mechanism 220 are configured to mount to a right ladder (not shown) and a left ladder (not shown), respectively, to position first shelf 118 within the enclosed space, on freezer compartment door 102, or on refrigerator compartment door 103. In the illustrative embodiment, first shelf 118 is mounted to a top of interior door plate 128 of refrigerator compartment door 103. Again, other mounting mechanisms may be used in alternative embodiments to mount first shelf 118 at various locations within the enclosed space, on freezer compartment door 102, or on refrigerator compartment door 103. In alternative embodiments, first shelf 118 may be mounted within other types of enclosed spaces or to other doors and not necessarily those of a refrigerator such as refrigerator 100. Application within refrigerator 100 is merely for illustration.

Figure 2B:
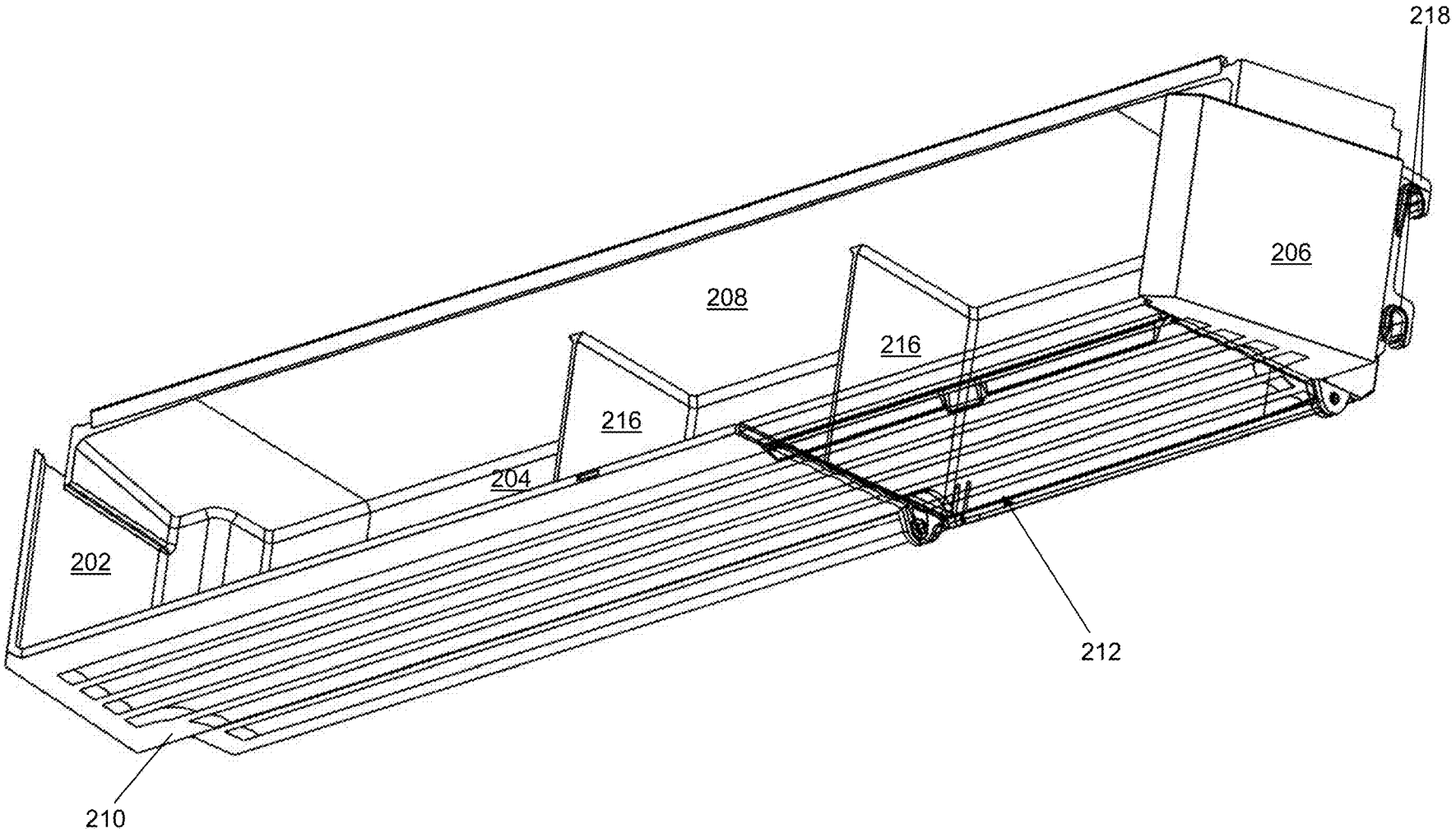
FIG. 2B depicts a bottom, right, front perspective view of the shelf of FIG. 2A with a shelf door removed in accordance with an illustrative embodiment.
Figure 2C:
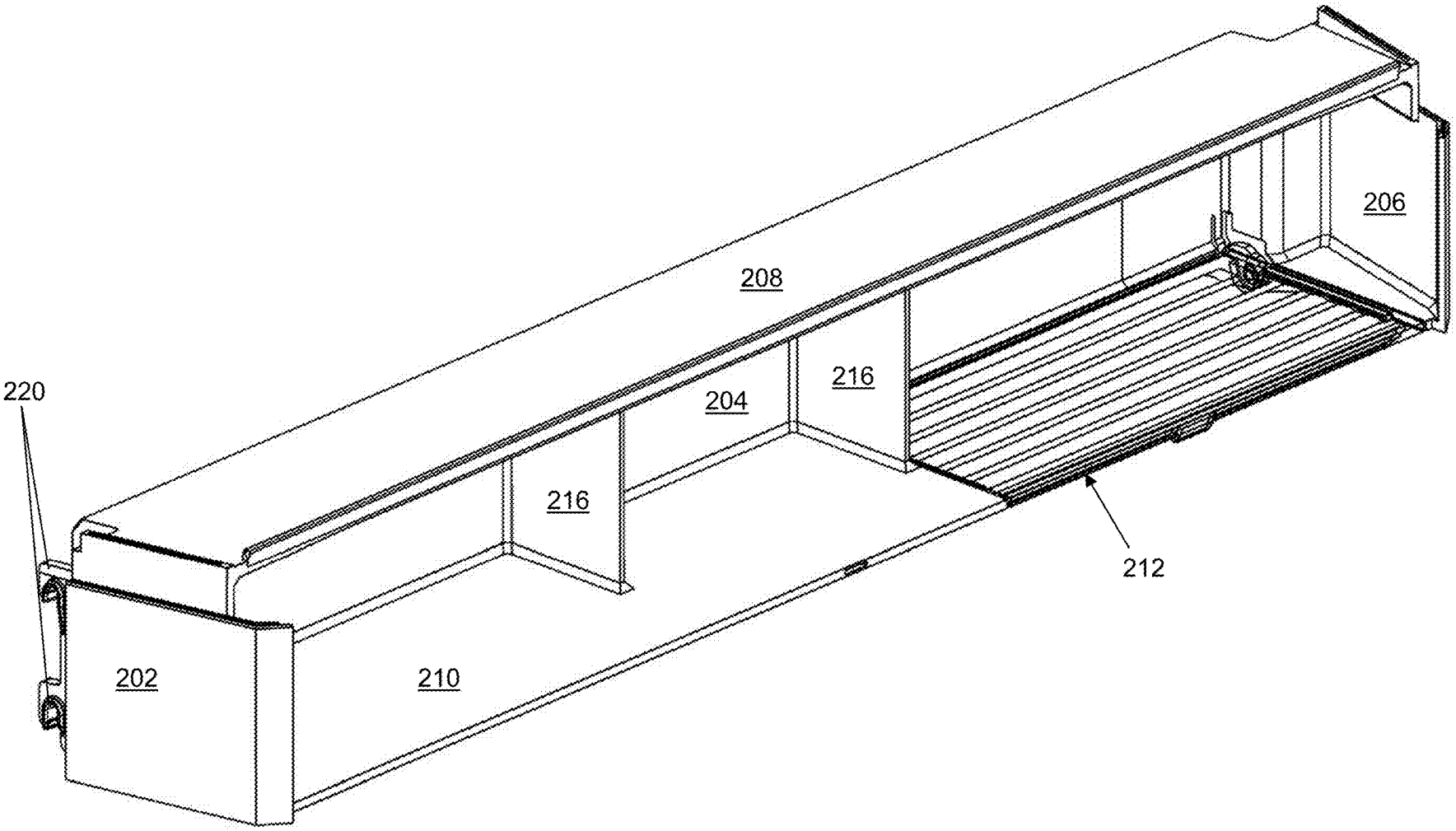
FIG. 2C depicts a top, left, front perspective view of the shelf of FIG. 2B in accordance with an illustrative embodiment.
Figure 2D:
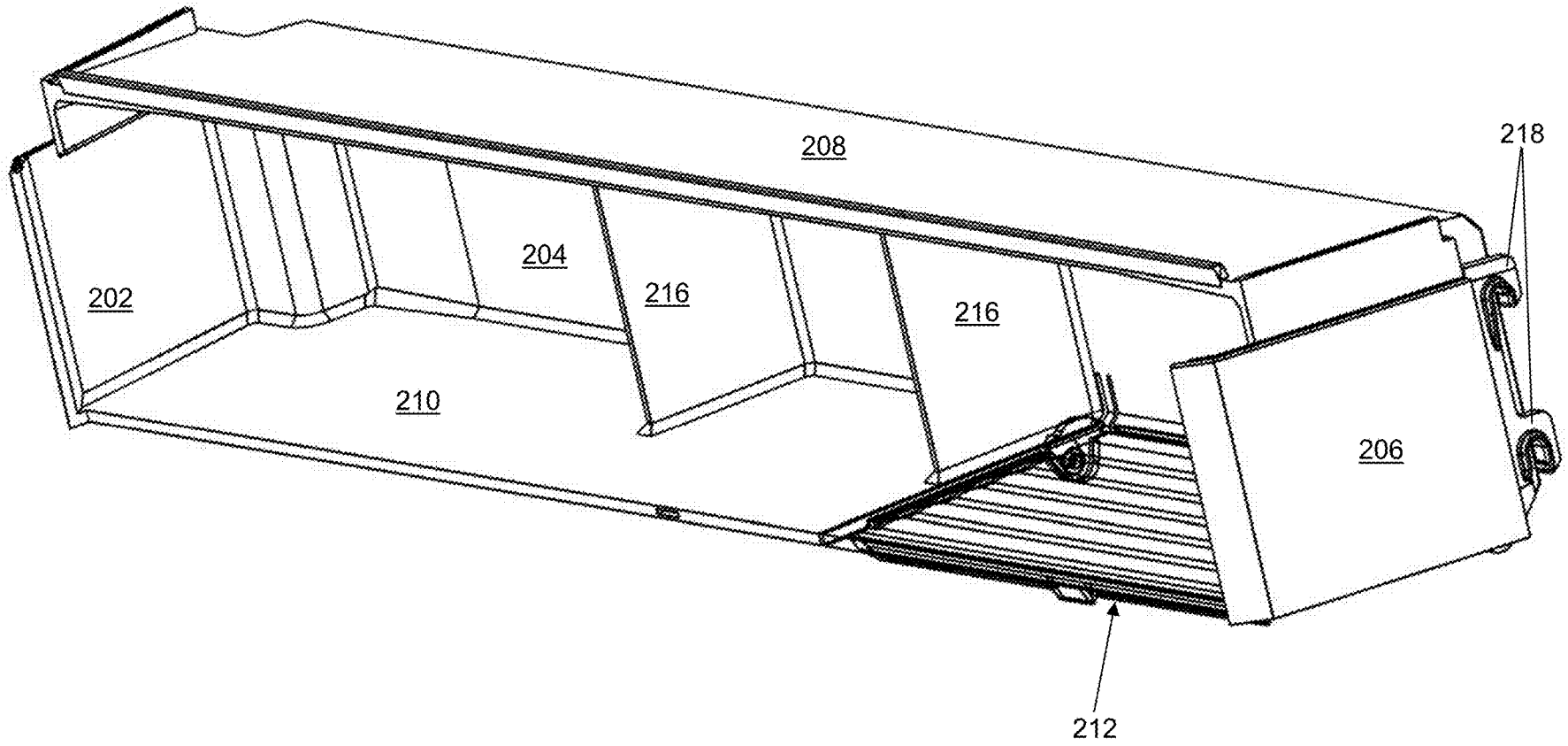
FIG. 2D depicts a top, right, front perspective view of the shelf of FIG. 2B in accordance with an illustrative embodiment.
Figure 2E:
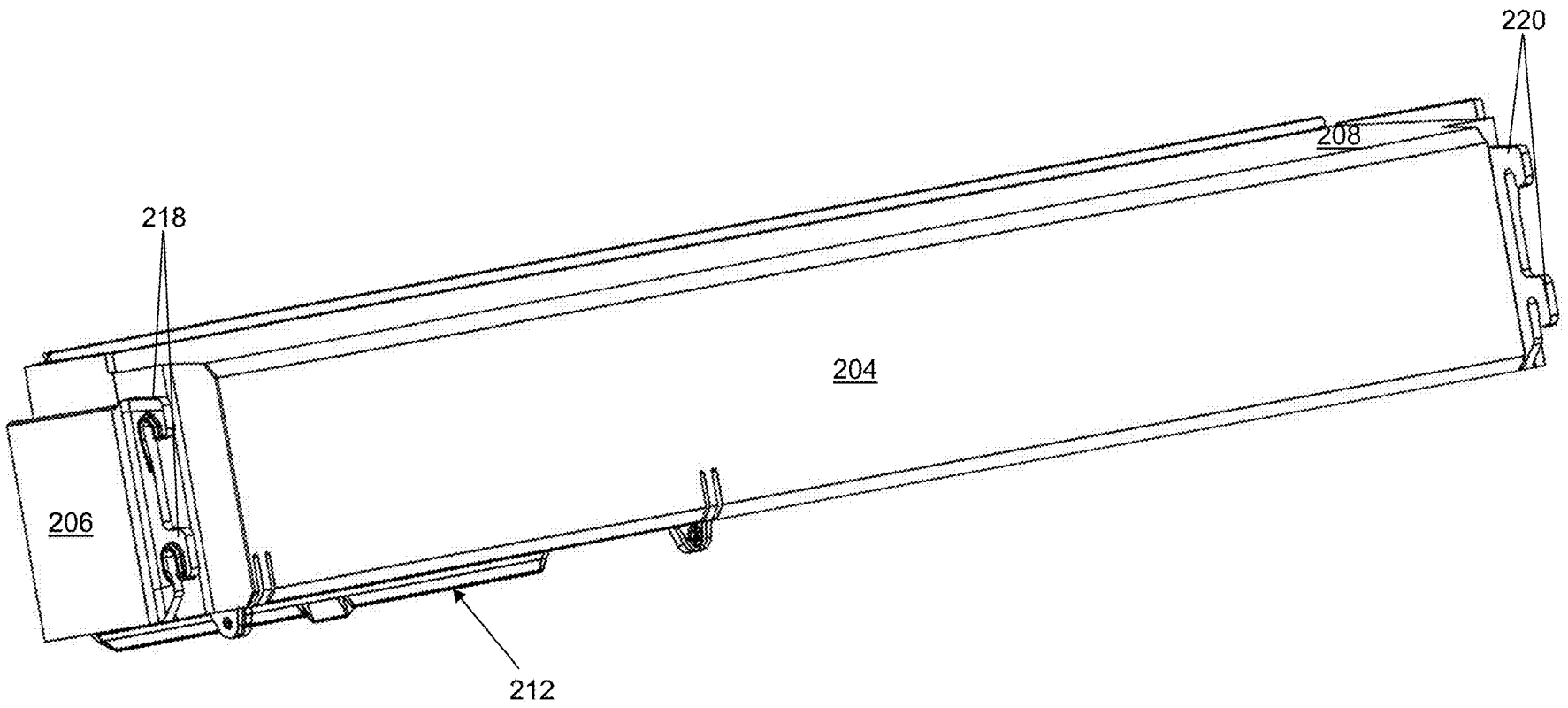
FIG. 2E depicts a right, back perspective view of the shelf of FIG. 2B in accordance with an illustrative embodiment.

Referring to FIG. 2B, a bottom, right, front perspective view of first shelf 118 with shelf door 200 removed is shown in accordance with an illustrative embodiment. Referring to FIG. 2C, a top, left, front perspective view of first shelf 118 with shelf door 200 removed is shown in accordance with an illustrative embodiment. Referring to FIG. 2D, a top, right, front perspective view of first shelf 118 with shelf door 200 removed is shown in accordance with an illustrative embodiment. Referring to FIG. 2E, a right, back perspective view of first shelf 118 with shelf door 200 removed is shown in accordance with an illustrative embodiment. The one or more components of first shelf 118 may be formed of one or more materials, such as metal, glass, and/or plastic having a sufficient strength and rigidity to support food items or other items, for example, stored in refrigerator 100 or other device to which first shelf 118 is mounted.

Figure 5A:
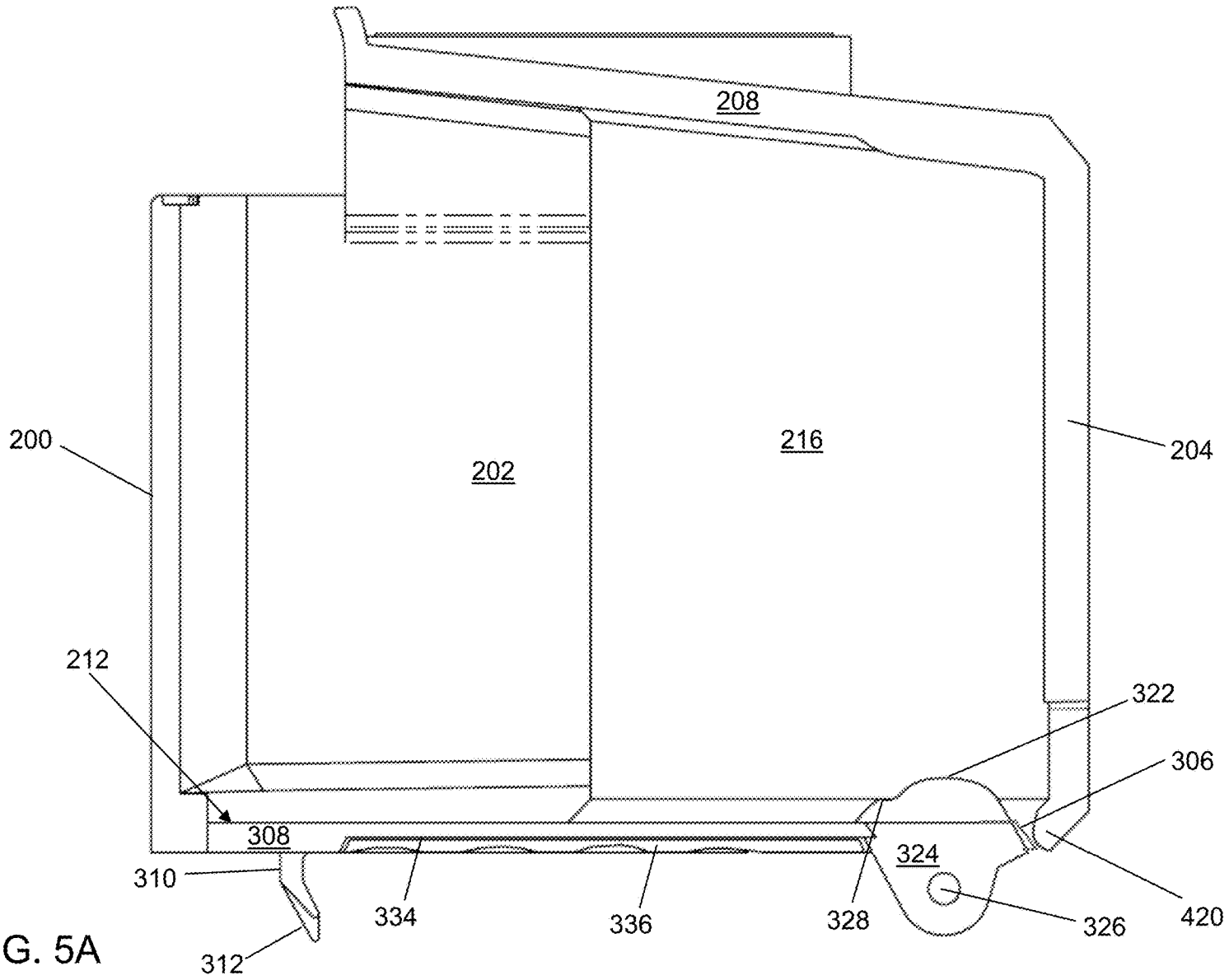
FIG. 5A depicts a right side view of the shelf of FIG. 2A with a shelf right side wall removed and a rotatable shelf in a down position in accordance with an illustrative embodiment.
Figure 5B:
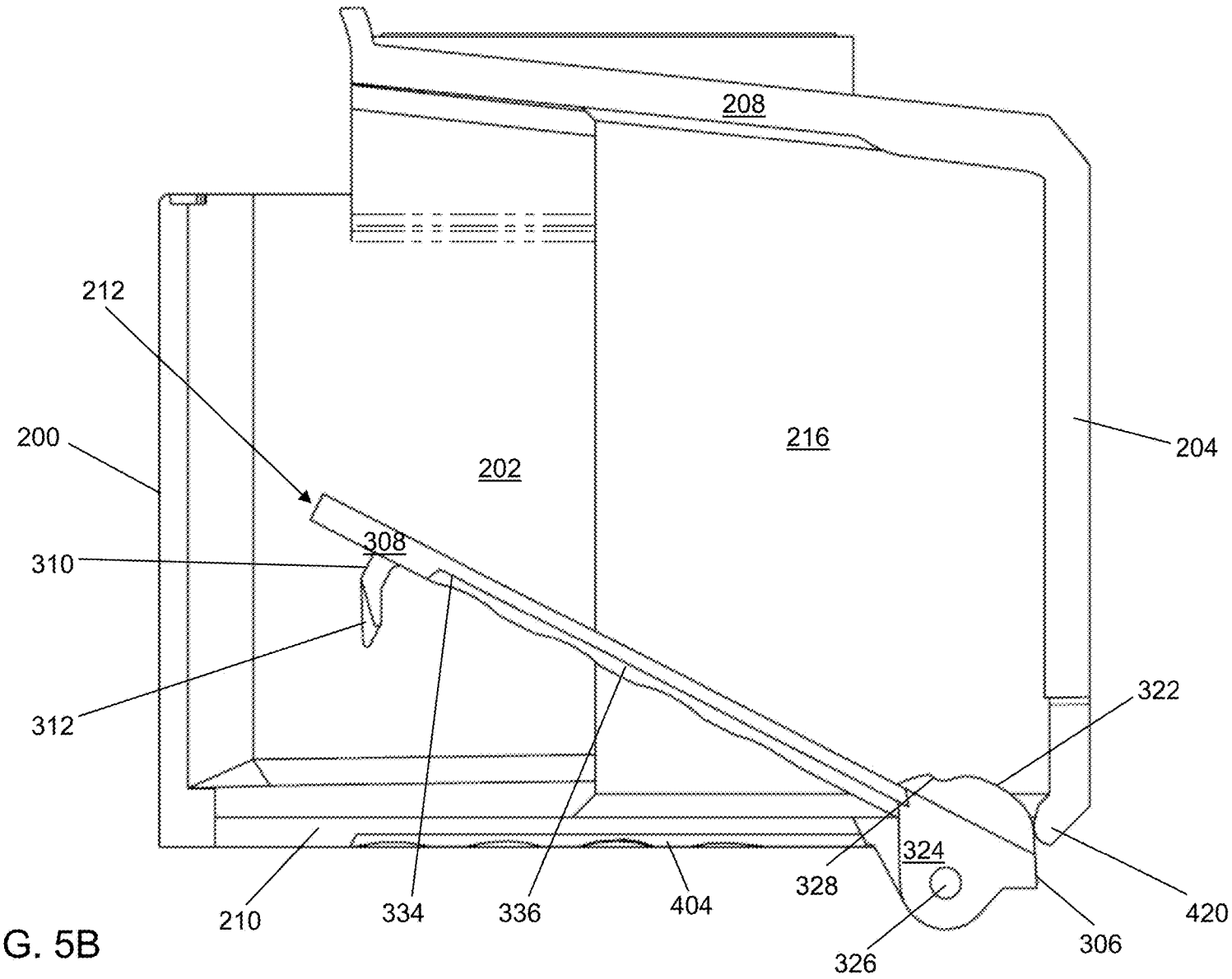
FIG. 5B depicts a right side view of the shelf of FIG. 5A with the rotatable shelf in a partially up position in accordance with an illustrative embodiment.
Figure 5C:
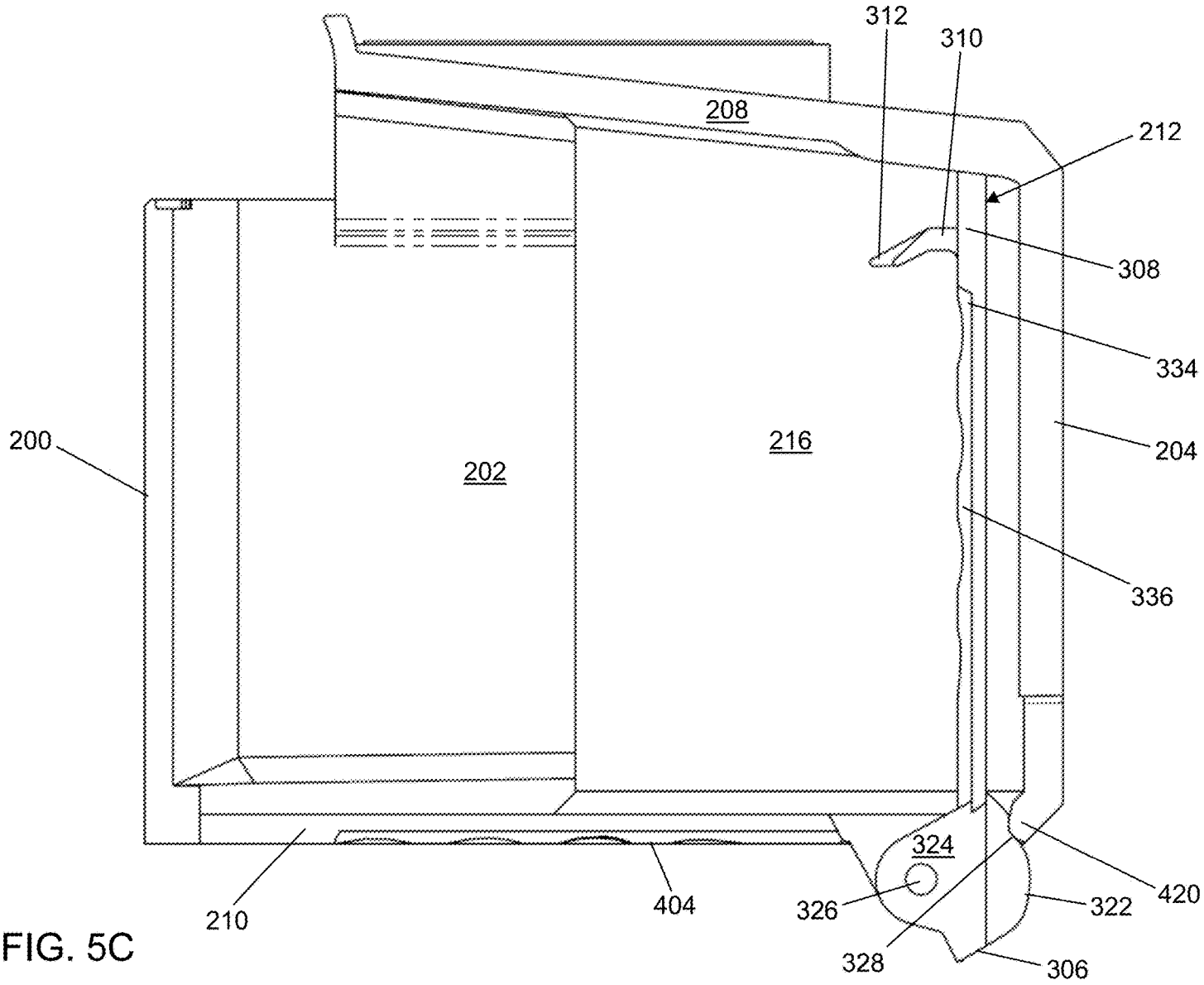
FIG. 5C depicts a right side view of the shelf of FIG. 5A with the rotatable shelf in a fully up position in accordance with an illustrative embodiment.

In the illustrative embodiment, rotatable shelf bottom wall 212 is mounted to be rotatable from a horizontal position as shown in FIGS. 2A-2E to an approximately vertical position as shown in FIG. 5C. In the illustrative embodiment, first shelf 118 includes shelf bottom wall 210 that is not rotatable. In alternative embodiments, first shelf 118 may not include shelf bottom wall 210 that is not rotatable such that an entirety of a bottom wall of first shelf 118 is rotatable from the horizontal position to the approximately vertical position.

Figure 3A:
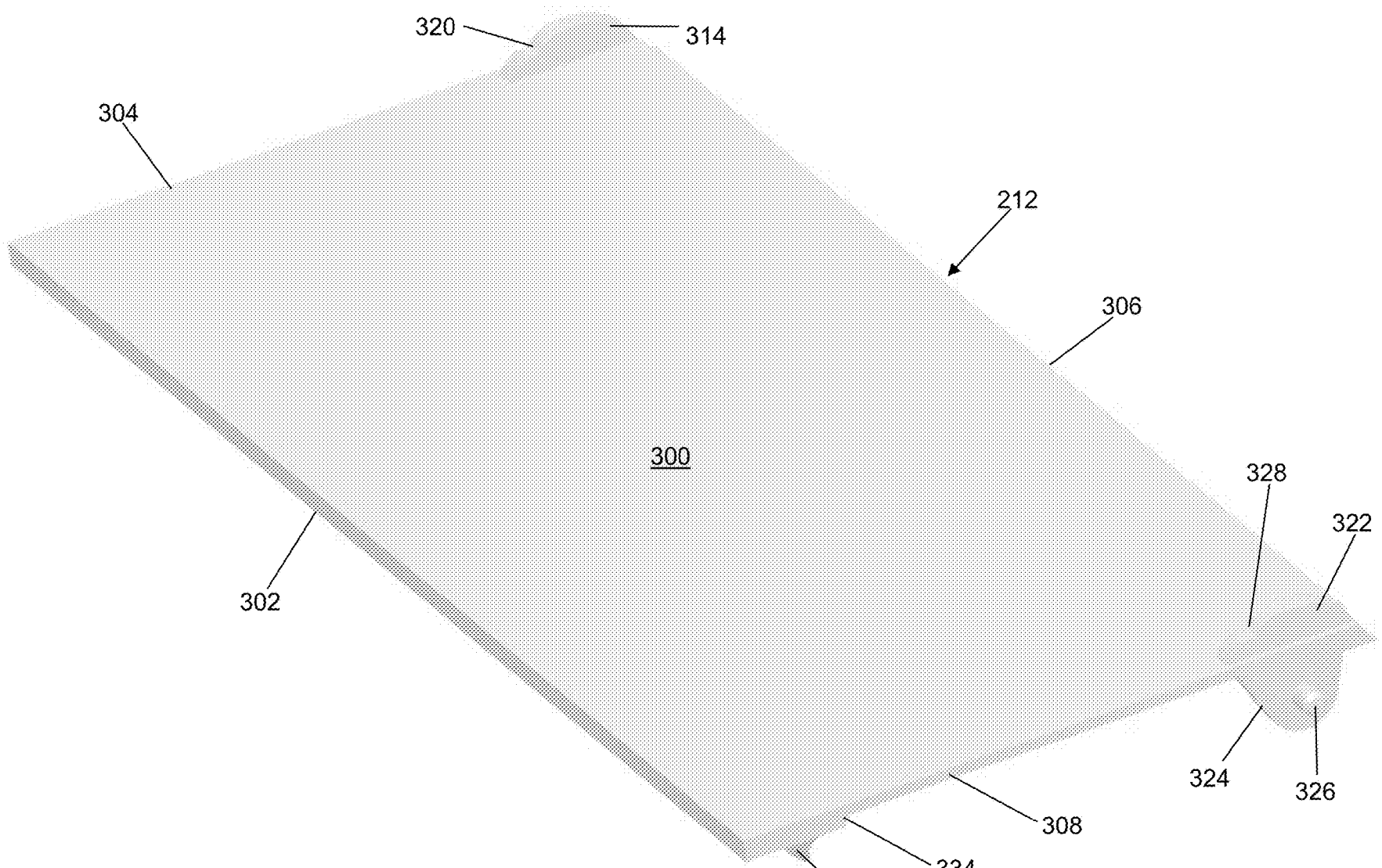
FIG. 3A depicts a top, right, front perspective view of a rotatable shelf floor of the shelf of FIG. 2A in accordance with an illustrative embodiment.
Figure 3B:
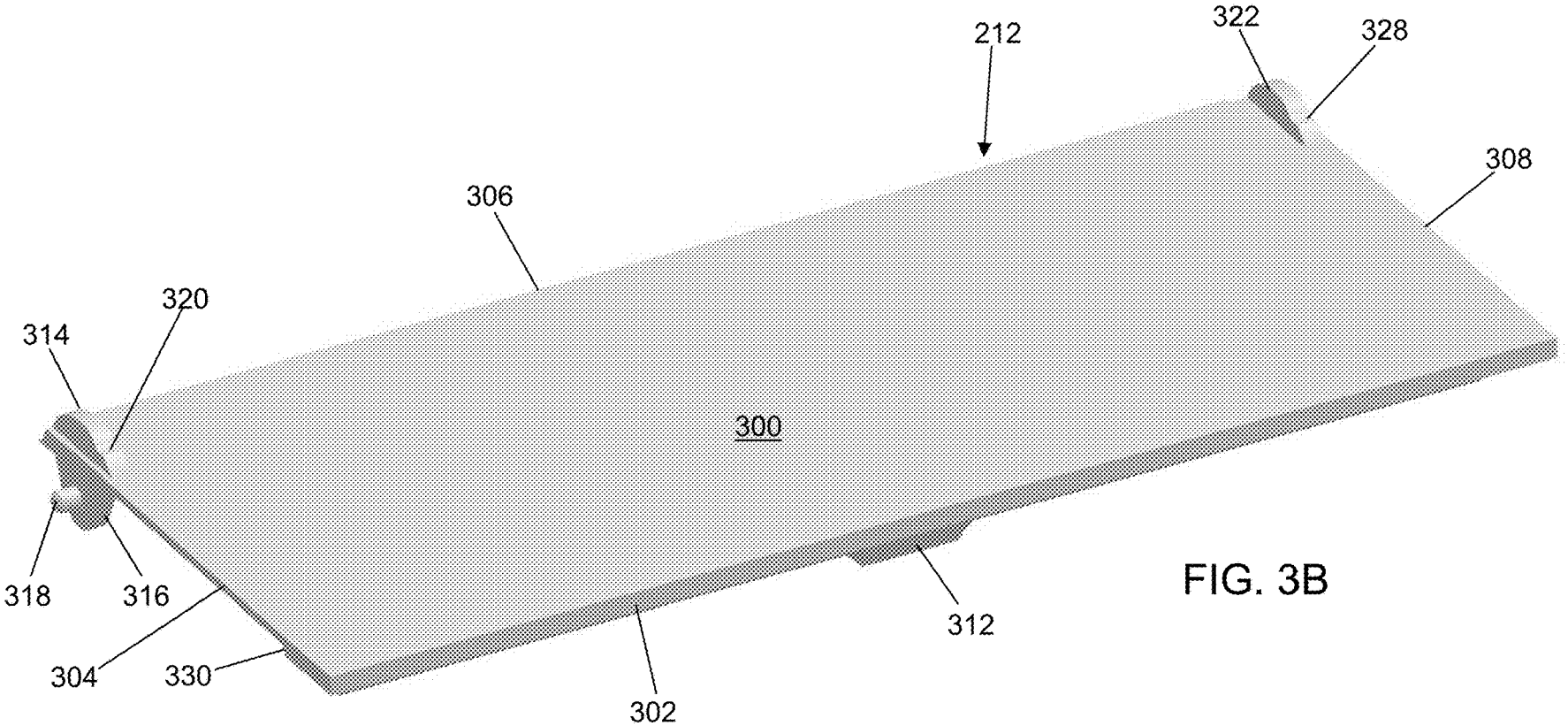
FIG. 3B depicts a top, left, front perspective view of the rotatable shelf floor of FIG. 3A in accordance with an illustrative embodiment.
Figure 3C:
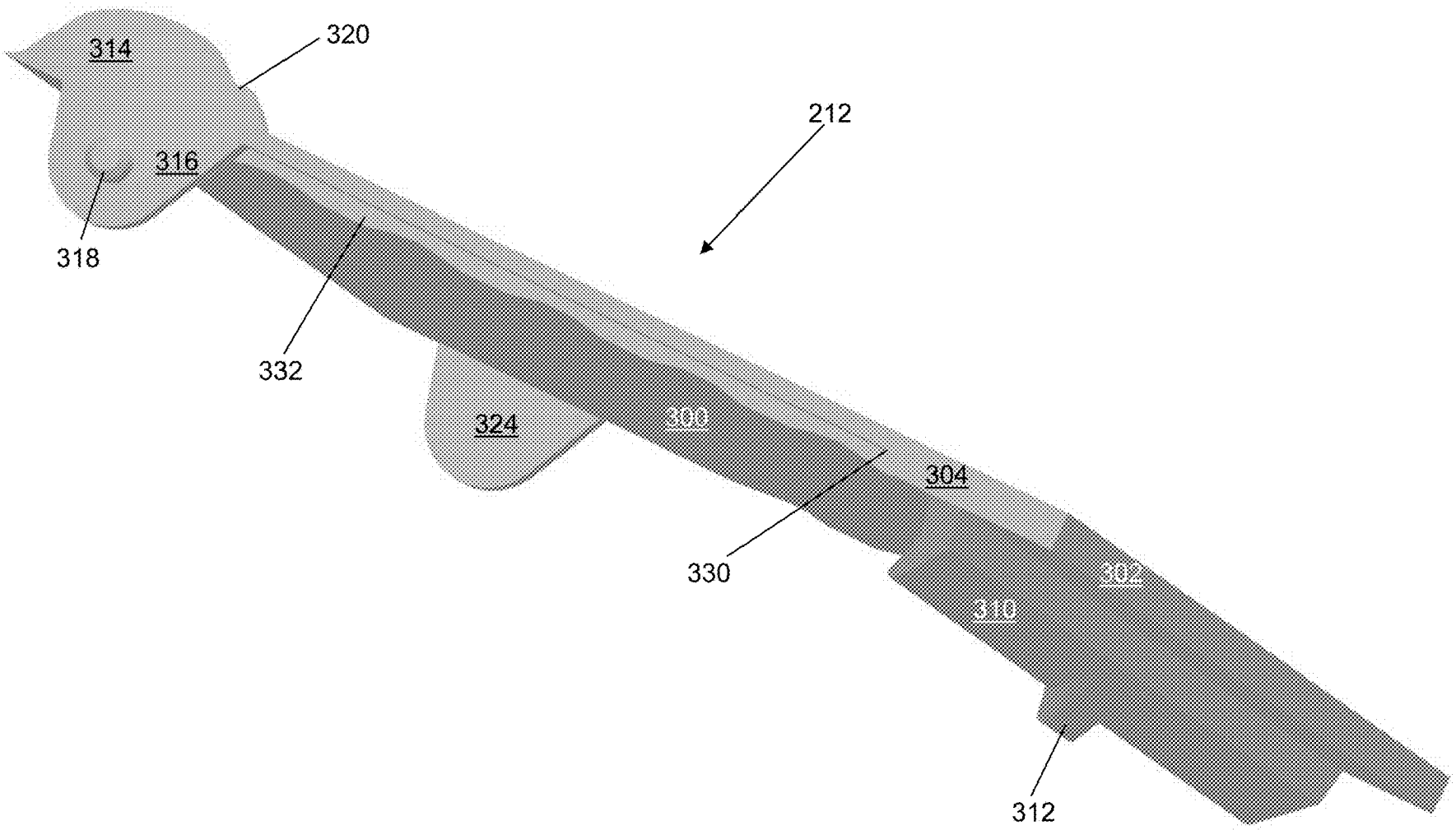
FIG. 3C depicts a bottom, left, front perspective view of the rotatable shelf floor of FIG. 3A in accordance with an illustrative embodiment.
Figure 3D:
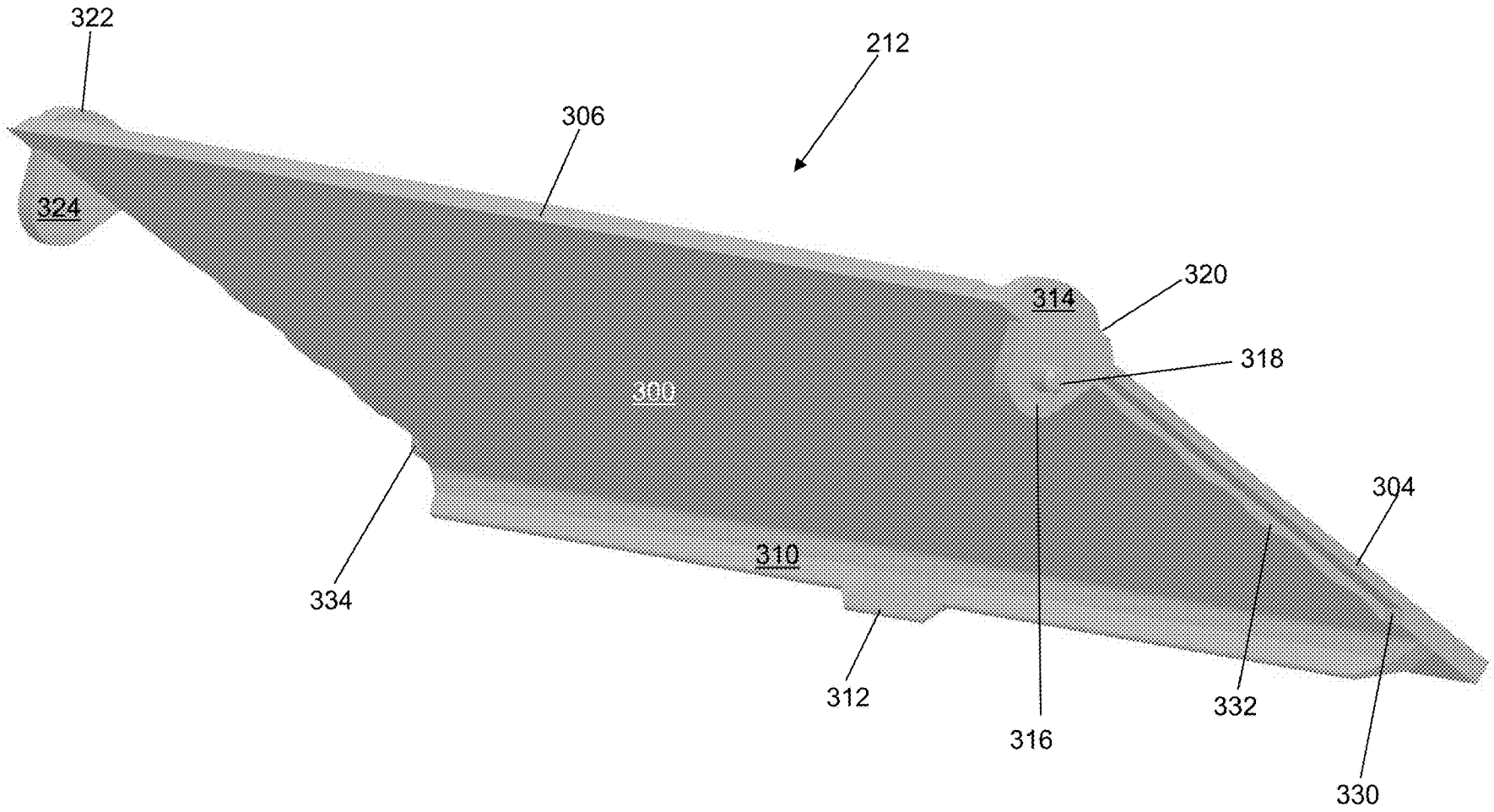
FIG. 3D depicts a bottom, left, back perspective view of the rotatable shelf floor of FIG. 3A in accordance with an illustrative embodiment.
Figure 3E:
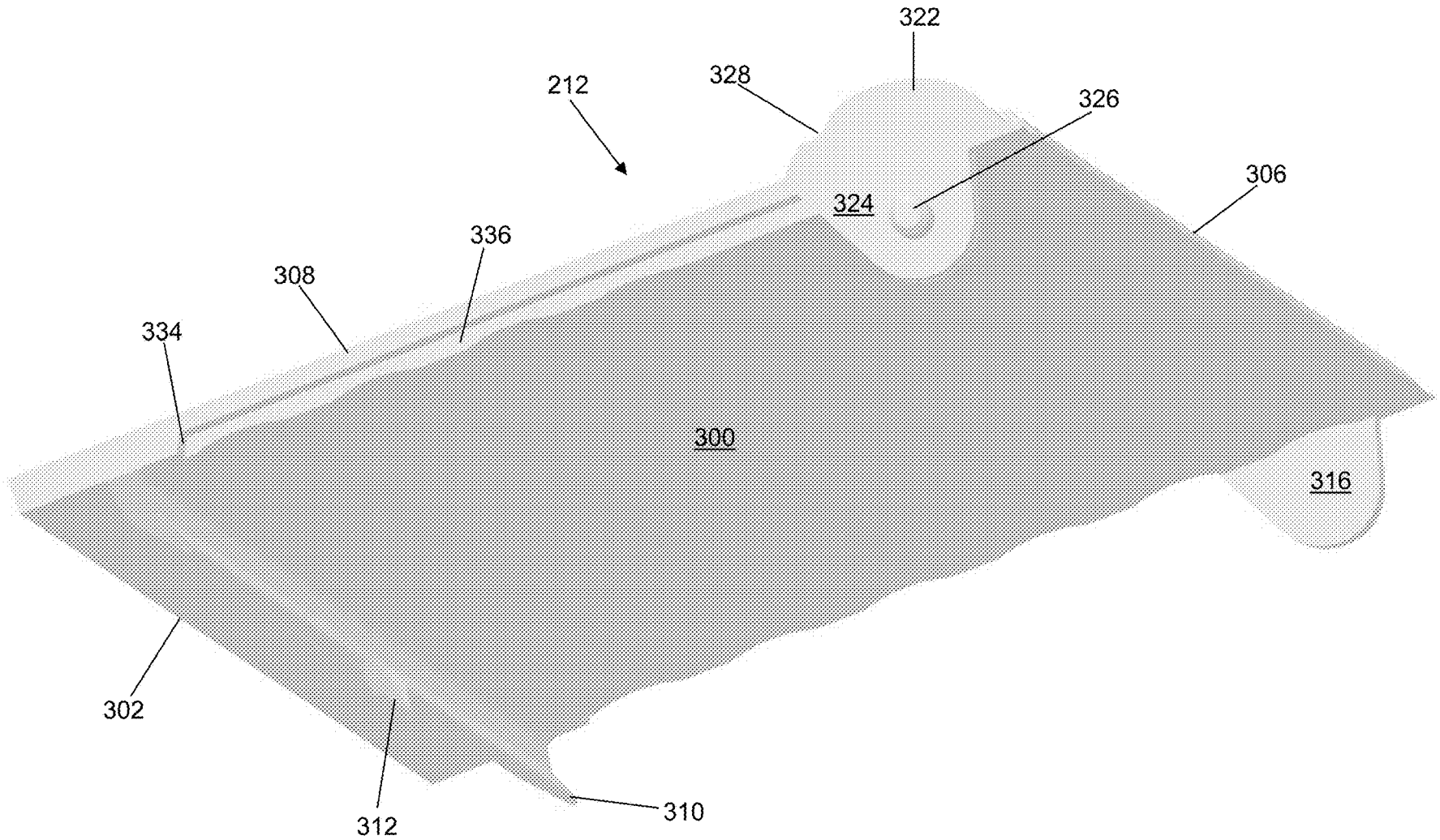
FIG. 3E depicts a bottom, right, back perspective view of the rotatable shelf floor of FIG. 3A in accordance with an illustrative embodiment.
Figure 3F:
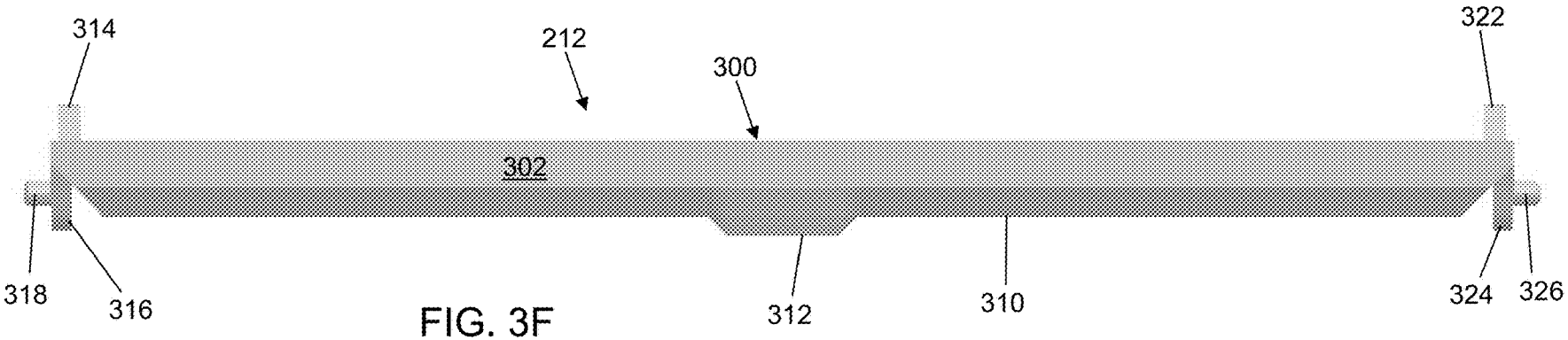
FIG. 3F depicts a front view of the rotatable shelf floor of FIG. 3A in accordance with an illustrative embodiment.
Figure 3G:
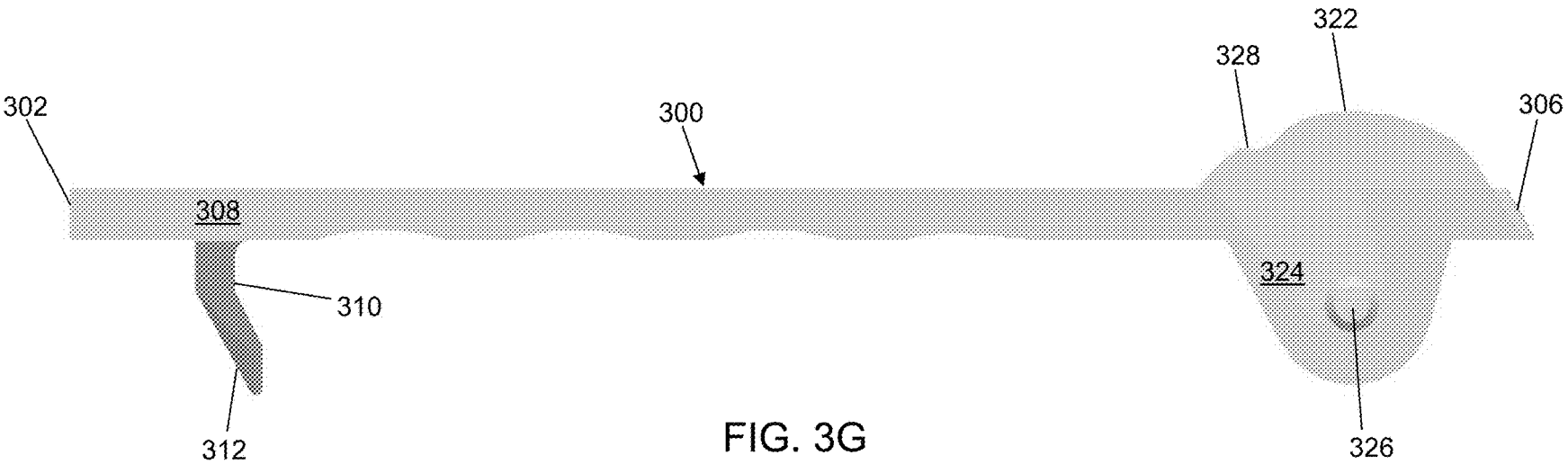
FIG. 3G depicts a right side view of the rotatable shelf floor of FIG. 3A in accordance with an illustrative embodiment.

Referring to FIG. 3A, a top, right, front perspective view of rotatable shelf bottom wall 212 is shown in accordance with an illustrative embodiment. Referring to FIG. 3B, a top, left, front perspective view of rotatable shelf bottom wall 212 is shown in accordance with an illustrative embodiment. Referring to FIG. 3C, a bottom, left, front perspective view of rotatable shelf bottom wall 212 is shown in accordance with an illustrative embodiment. Referring to FIG. 3D, a bottom, left, back perspective view of rotatable shelf bottom wall 212 is shown in accordance with an illustrative embodiment. Referring to FIG. 3E, a bottom, right, back perspective view of rotatable shelf bottom wall 212 is shown in accordance with an illustrative embodiment. Referring to FIG. 3F, a front view of rotatable shelf bottom wall 212 is shown in accordance with an illustrative embodiment. Referring to FIG. 3G, a right side view of rotatable shelf bottom wall 212 is shown in accordance with an illustrative embodiment.

Rotatable shelf bottom wall 212 may include a floor plate 300, a handle 310, a left cam plate 314, a right cam plate 322, a first, left pin joint plate 316, and a first, right pin joint plate 324. Floor plate 300 may include a front edge 302, a left edge 304, a back edge 306, and a right edge 308. Back edge 306 is closest to shelf back wall 204 or, for example, to interior door plate 128 when rotatable shelf bottom wall 212 is mounted adjacent interior door plate 128 and first shelf 118 does not include shelf back wall 204. Right edge 308 extends between front edge 302 and back edge 306. Left edge 304 extends between front edge 302 and back edge 306.

Floor plate 300 may be generally flat so that an item can be placed on a top surface of floor plate 300 for storage of the item. In the illustrative embodiment, front edge 302, left edge 304, and right edge 308 are generally flat while back edge 306 slopes downwards. Though shown in the illustrative embodiment as forming a generally rectangular shaped plate, rotatable shelf bottom wall 212 may form other shapes including other polygons as well as circular or elliptical plates.

In the illustrative embodiment, handle 310 is mounted to a lower surface of floor plate 300 to extend away from the lower surface at an angle, and handle 310 is positioned closer to front edge 302 than back edge 306. A finger hold 312 may extend from handle 310 and provide a surface that a user can press against to pull rotatable shelf bottom wall 212 back to or toward the horizontal position though the user can touch other portions of handle 310 as well to pull rotatable shelf bottom wall 212 back to or toward the horizontal position. In an alternative embodiment, handle 310 may extend from front edge 302 or other surfaces of floor plate 300.

Left cam plate 314 is mounted to floor plate 300 to extend away from an upper surface of floor plate 300. A top edge of left cam plate 314 is opposite a bottom edge of left cam plate 314 that is mounted to the upper surface of floor plate 300. The top edge of left cam plate 314 has a concave shape that curves inward toward the upper surface of floor plate 300. In the illustrative embodiment, left cam plate 314 is mounted to floor plate 300 adjacent back edge 306, is at least partially above first, left pin joint plate 316 when floor plate 300 is in a horizontal position, and is centered above first, left pin joint plate 316 in a direction from front edge 302 to back edge 306. The top edge of left cam plate 314 is elongated to extend from back edge 306 toward front edge 302.

A left notch 320 is formed in the top edge of left cam plate 314. An end of a left tab 416 (shown referring to FIGS. 4B-4D) engages with left notch 320 when floor plate 300 is rotated to extend in a direction that is approximately parallel to shelf back wall 204 or, for example, to interior door plate 128 when rotatable shelf bottom wall 212 is mounted adjacent interior door plate 128 and first shelf 118 does not include shelf back wall 204. Left notch 320 is formed in a front half of the top edge of left cam plate 314. As measured relative to a center of the elongated top edge, the front half of the top edge is on a side of the center toward front edge 302.

First, left pin joint plate 316 is mounted to floor plate 300 to extend away from a lower surface of floor plate 300. A bottom edge of first, left pin joint plate 316 is opposite a top edge of first, left pin joint plate 316 that is mounted to the lower surface of floor plate 300. The bottom edge of first, left pin joint plate 316 has a concave shape that curves inward toward the lower surface of floor plate 300 though other shapes may be used in alternative embodiments. In the illustrative embodiment, first, left pin joint plate 316 is mounted to floor plate 300 adjacent back edge 306. The bottom edge of first, left pin joint plate 316 extends from back edge 306 toward front edge 302.

First, left pin joint plate 316 is configured to mate with a second, left pin joint plate 400 (shown referring to FIGS. 4A, 4B, and 4D) mounted to shelf bottom wall 210. In an alternative embodiment, first, left pin joint plate 316 may be mounted to extend from other walls of refrigerator 100 (or other device to which first shelf 118 is mounted) or of first shelf 118, such as shelf left side wall 202. For example, first, left pin joint plate 316 includes a left pin 318 that extends outward in a generally perpendicular direction toward second, left pin joint plate 400, and second, left pin joint plate 400 includes a left aperture 402 formed horizontally through second, left pin joint plate 400. Left pin 318 is sized and shaped to fit within left aperture 402. Rotatable shelf bottom wall 212 is mounted to first shelf 118 by inserting left pin 318 into left aperture 402. A length that left pin 318 extends perpendicular from first, left pin joint plate 316 may be selected to provide sufficient strength and rigidity to support items on floor plate 300 while being flexible enough for insertion into left aperture 402. In an alternative embodiment, left aperture 402 may be formed through first, left pin joint plate 316, and left pin 318 may extend from second, left pin joint plate 400 toward first, left pin joint plate 316. Other mechanisms for mounting rotatable shelf bottom wall 212 for rotation upward relative to other components of first shelf 118 may be used in alternative embodiments.

Right cam plate 322 is mounted to floor plate 300 to extend away from an upper surface of floor plate 300. A top edge of right cam plate 322 is opposite a bottom edge of right cam plate 322 that is mounted to the upper surface of floor plate 300. The top edge of right cam plate 322 has a concave shape that curves inward toward the upper surface of floor plate 300. In the illustrative embodiment, right cam plate 322 is mounted to floor plate 300 adjacent back edge 306, is at least partially above first, right pin joint plate 324 when floor plate 300 is in a horizontal position, and is centered above first, right pin joint plate 324 in a direction from front edge 302 to back edge 306. The top edge of right cam plate 322 is elongated to extend from back edge 306 toward front edge 302.

A right notch 328 is formed in the top edge of right cam plate 322. An end of a right tab 420 (shown referring to FIGS. 4C and 4D) engages with right notch 328 (as shown referring to FIG. 5C) when floor plate 300 is rotated to extend in a direction that is approximately parallel to shelf back wall 204 or, for example, to interior door plate 128 when rotatable shelf bottom wall 212 is mounted adjacent interior door plate 128 and first shelf 118 does not include shelf back wall 204. Right notch 328 is formed in a front half of the top edge of right cam plate 322. As measured relative to a center of the elongated top edge, the front half of the top edge is on a side of the center toward front edge 302.

First, right pin joint plate 324 is mounted to floor plate 300 to extend away from the lower surface of floor plate 300. A bottom edge of first, right pin joint plate 324 is opposite a top edge of right pin joint plate 324 that is mounted to the lower surface of floor plate 300. The bottom edge of first, right pin joint plate 324 has a concave shape that curves inward toward the lower surface of floor plate 300 though other shapes may be used in alternative embodiments. In the illustrative embodiment, first, right pin joint plate 324 is mounted to floor plate 300 adjacent back edge 306. The bottom edge of first, right pin joint plate 324 extends from back edge 306 toward front edge 302.

First, right pin joint plate 324 is configured to mate with a second, right pin joint plate 406 (shown referring to FIGS. 4B and 4D) mounted to shelf bottom wall 210. In an alternative embodiment, first, right pin joint plate 324 may be mounted to extend from other walls of refrigerator 100 (or other device to which first shelf 118 is mounted) or of first shelf 118, such as shelf right side wall 206. For example, first, right pin joint plate 324 includes a right pin 326 that extends outward in a generally perpendicular direction toward second, right pin joint plate 406, and second, right pin joint plate 406 includes a right aperture 408 formed horizontally through second, right pin joint plate 406. Right pin 326 is sized and shaped to fit within right aperture 408. Rotatable shelf bottom wall 212 is mounted to first shelf 118 by inserting right pin 326 into right aperture 408. A length that right pin 326 extends perpendicular from first, right pin joint plate 324 may be selected to provide sufficient strength and rigidity to support items on floor plate 300 while being flexible enough for insertion into right aperture 408. In an alternative embodiment, right aperture 408 may be formed through first, right pin joint plate 324, and right pin 326 may extend from second, right pin joint plate 406 toward first, right pin joint plate 324.

Right cam plate 322 is mounted to floor plate 300 adjacent a right corner defined where right edge 308 meets back edge 306, and left cam plate 314 is mounted to floor plate 300 adjacent a left corner defined where left edge 304 meets back edge 306. Rotatable shelf bottom wall 212 may include a fewer or a greater number of cam plates at various locations along back edge 306. In an illustrative embodiment, rotatable shelf bottom wall 212 may be formed using a molding process so that some or all of the described elements may be integrally formed together.

To provide a flat mating surface with shelf bottom wall 210, floor plate 300 may include a left floor notch 330 formed in left edge 304 that defines a left recessed wall 332 and a right floor notch 334 formed in right edge 308 that defines a right recessed wall 336. Left floor notch 330 forms an overhang sized and shaped to abut a left support shelf 404 (shown referring to FIGS. 4A-4D) that extends from shelf bottom wall 210 toward shelf right side wall 206 when rotatable shelf bottom wall 212 is in the horizontal position. Right floor notch 334 forms an overhang sized and shaped to abut a right support shelf 410 (shown referring to FIGS. 4B and 4C) that extends from a bottom edge of shelf right side wall 206 toward shelf left side wall 202 when rotatable shelf bottom wall 212 is in the horizontal position. Left support shelf 404 and right support shelf 410 are configured to have a sufficient size and rigidity to support floor plate 300 when items are placed on floor plate 300. Depending on a location of rotatable shelf bottom wall 212 within first shelf 118, left support shelf 404 and/or right support shelf 410 may extend from shelf bottom wall 210, shelf right side wall 206, shelf left side wall 202, and/or shelf back wall 204.

Figure 4A:
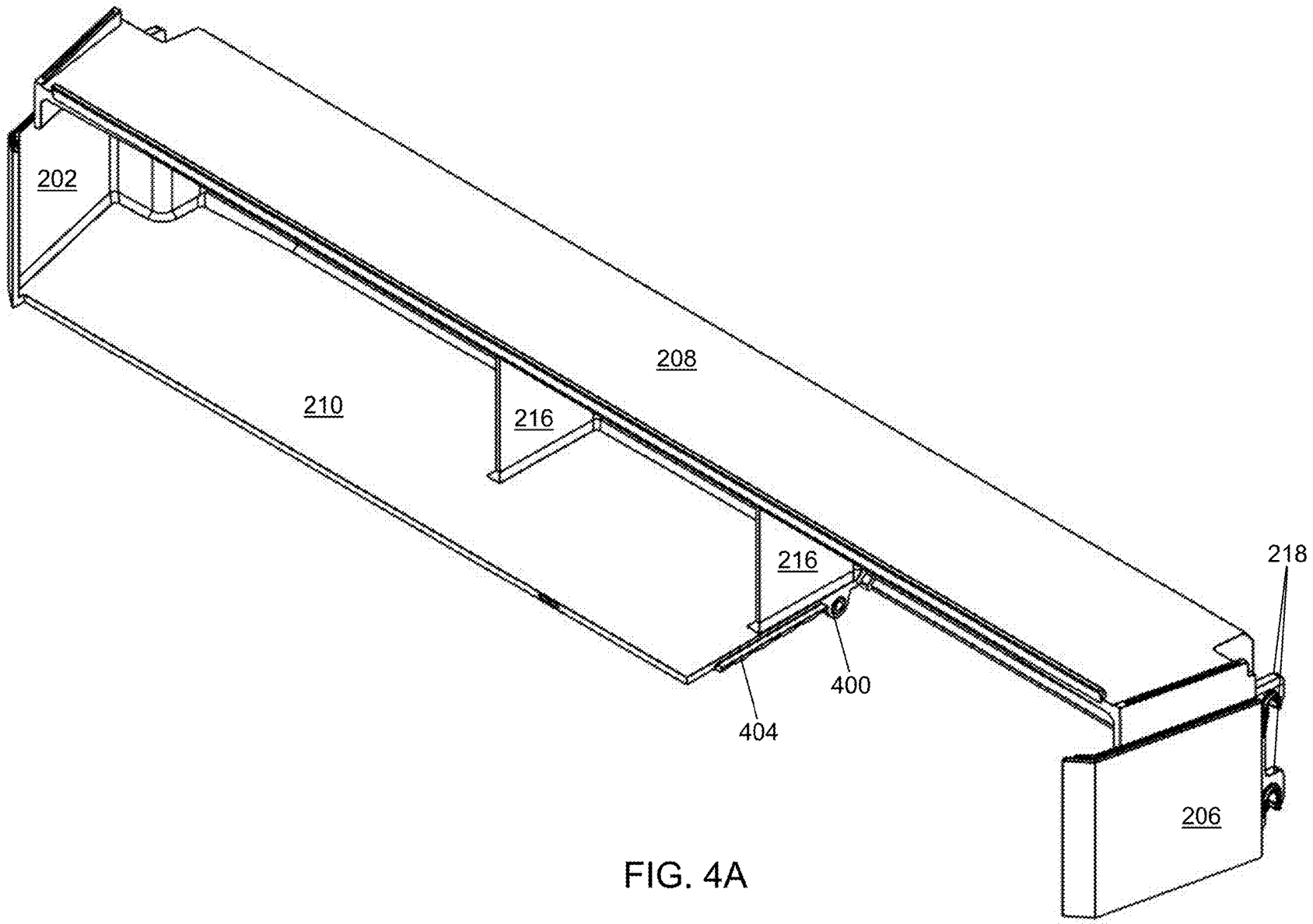
FIG. 4A depicts a top, right, front perspective view of the shelf of FIG. 2A with the shelf door and the rotatable shelf floor removed in accordance with an illustrative embodiment.
Figure 4B:
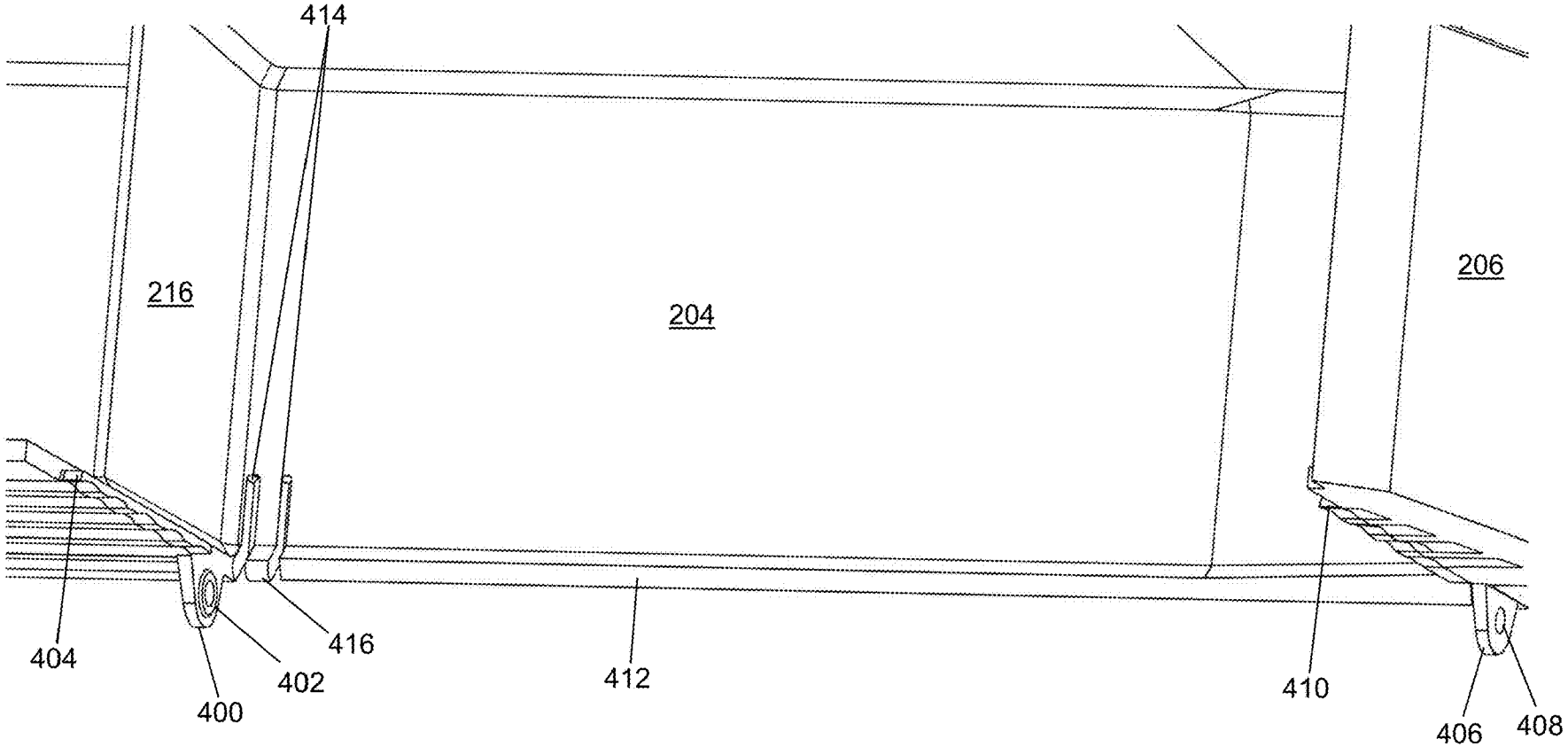
FIG. 4B depicts a zoomed bottom, right, front perspective view of the shelf of FIG. 4A in accordance with an illustrative embodiment.
Figure 4C:
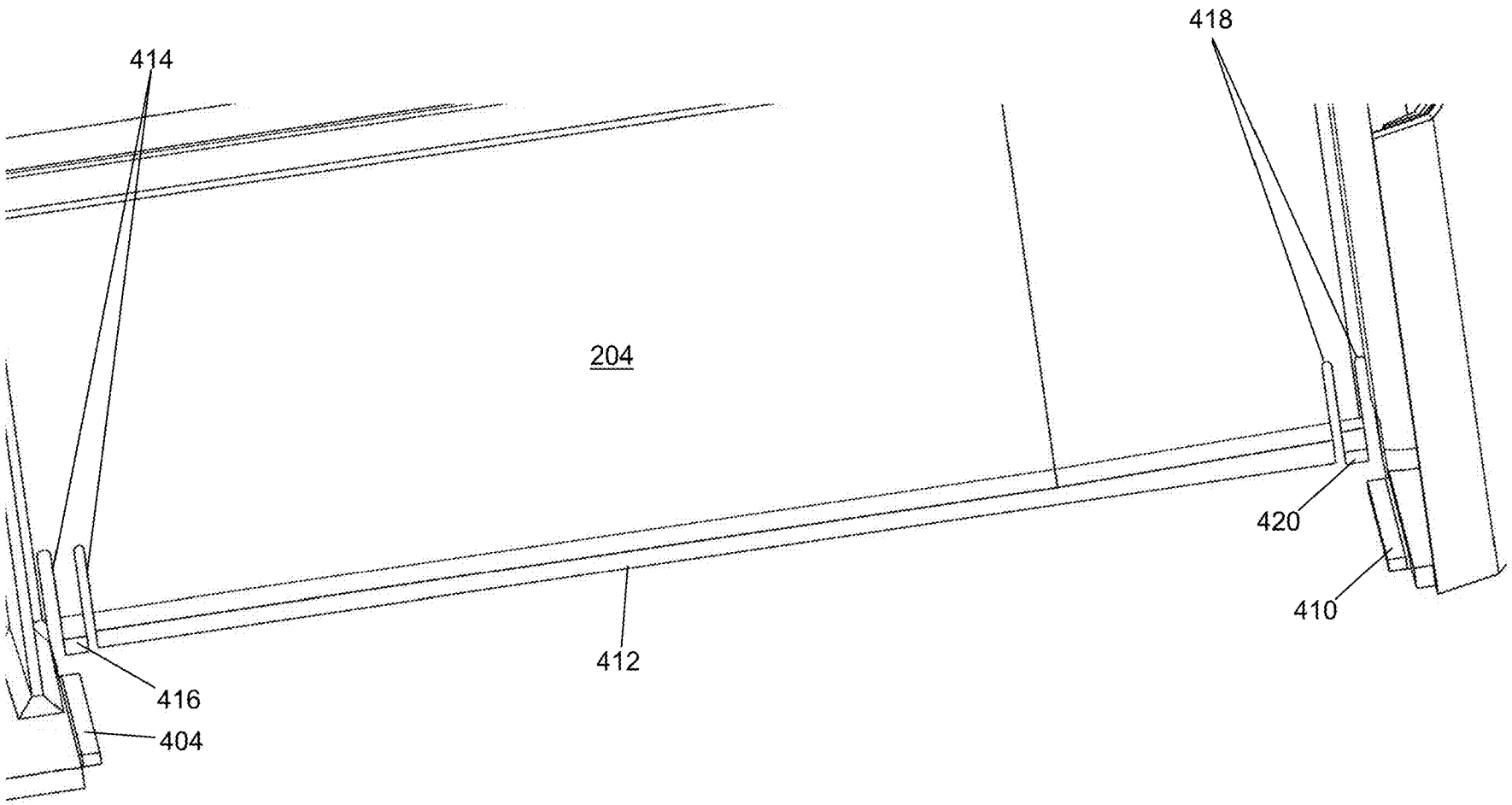
FIG. 4C depicts a zoomed top, front perspective view of the shelf of FIG. 4A in accordance with an illustrative embodiment.
Figure 4D:
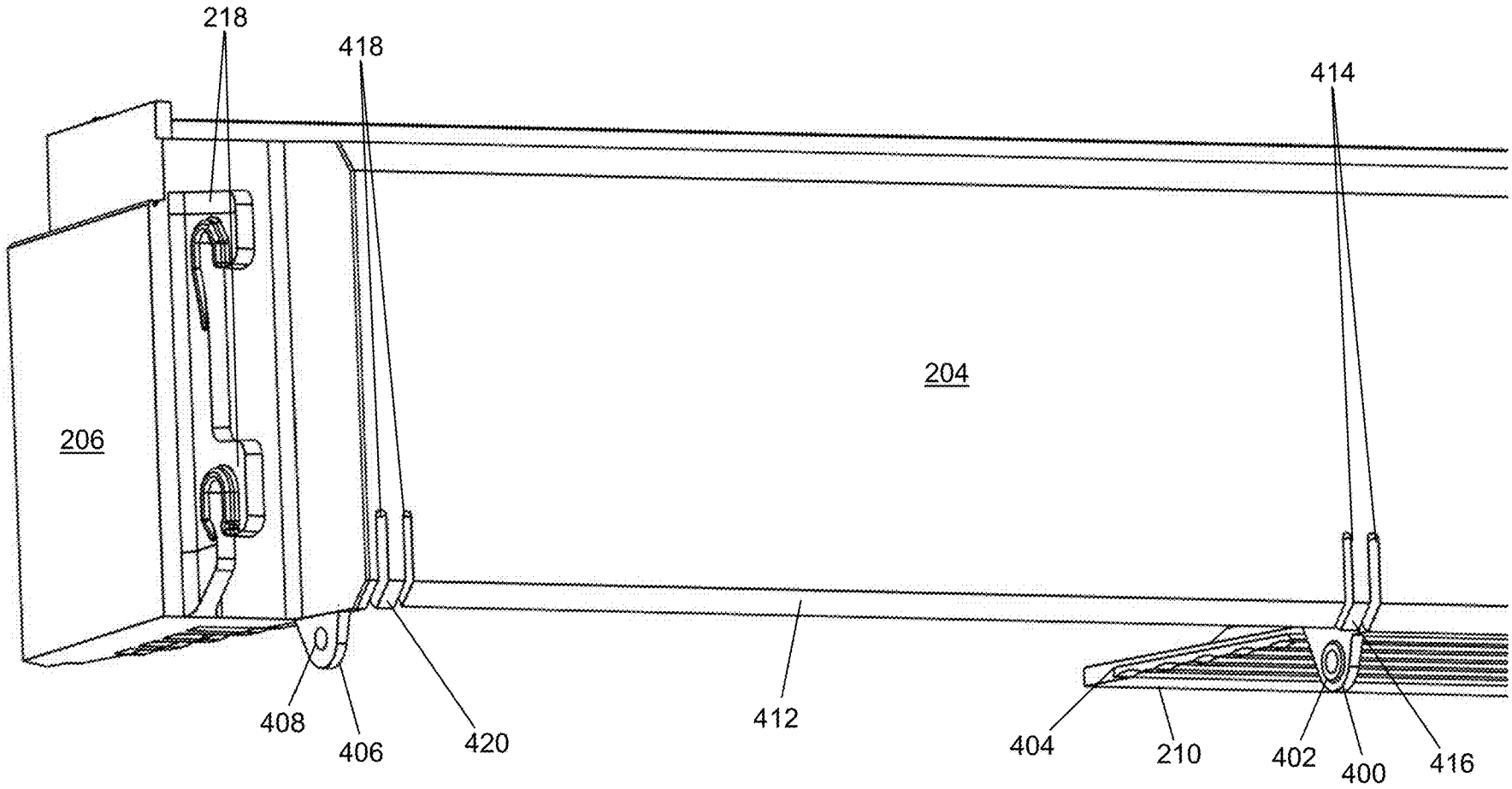
FIG. 4D depicts a zoomed bottom, right, back perspective view of the shelf of FIG. 4A in accordance with an illustrative embodiment.

Referring to FIG. 4A, a top, right, front perspective view of first shelf 118 with shelf door 200 and rotatable shelf bottom wall 212 removed is shown in accordance with an illustrative embodiment. Referring to FIG. 4B, a zoomed bottom, right, front perspective view of first shelf 118 with shelf door 200 and rotatable shelf bottom wall 212 removed is shown in accordance with an illustrative embodiment. Referring to FIG. 4C, a zoomed top, front perspective view of first shelf 118 with shelf door 200 and rotatable shelf bottom wall 212 removed is shown in accordance with an illustrative embodiment. Referring to FIG. 4D, a zoomed bottom, right, back perspective view of first shelf 118 with shelf door 200 and rotatable shelf bottom wall 212 removed is shown in accordance with an illustrative embodiment.

Left tab 416 is formed by a pair of apertures 414 formed through shelf back wall 204 along a lower edge 412 of shelf back wall 204. Right tab 420 is formed by a pair of apertures 418 formed through shelf back wall 204 along lower edge 412 of shelf back wall 204. Left tab 416 is positioned so that left cam plate 314 abuts left tab 416 to provide a spring force against the top edge of left cam plate 314 when rotatable shelf bottom wall 212 is rotated upwards from the horizontal position. Right tab 420 is positioned so that right cam plate 322 abuts right tab 420 to provide a spring force against the top edge of right cam plate 322 when rotatable shelf bottom wall 212 is rotated upwards from the horizontal position. Lower edge 412 of shelf back wall 204 is curved towards shelf door 200 in an illustrative embodiment.

Referring to FIG. 5A, a right side view of first shelf 118 with shelf right side wall 206 removed and with rotatable shelf bottom wall 212 in the horizontal position is shown in accordance with an illustrative embodiment. A lower edge of left tab 416 and a lower edge of right tab 420 abut back edge 306 of floor plate 300.

Referring to FIG. 5B, a right side view of first shelf 118 with shelf right side wall 206 removed and with rotatable shelf bottom wall 212 in a partially up position is shown in accordance with an illustrative embodiment. The spring force provided by left tab 416 against the top edge of left cam plate 314 and by right tab 420 against the top edge of right cam plate 322 may be selected to hold rotatable shelf bottom wall 212 at the rotated position against the force of gravity.

Referring to FIG. 5C, a right side view of first shelf 118 with shelf right side wall 206 removed and with rotatable shelf bottom wall 212 in a fully up position is shown in accordance with an illustrative embodiment. In the illustrative embodiment, the fully up position is approximately vertical or parallel to shelf back wall 204. When rotated to the fully up position, left tab 416 abuts left notch 320 of the top edge of left cam plate 314 and right tab 420 abuts right notch 328 of the top edge of right cam plate 322 to stop further rotation of rotatable shelf bottom wall 212 and to hold rotatable shelf bottom wall 212 in the fully up position.

Referring again to FIG. 1, first shelf 118 is mounted above another storage device such as a lower door shelf. Rotatable shelf bottom wall 212 allows items that are taller than a distance between the floor of the lower door shelf and rotatable shelf bottom wall 212 to be placed in the lower door shelf by rotating rotatable shelf bottom wall 212 upward. In the illustrative embodiment, shelf door 200, shelf left side wall 202, shelf back wall 204, shelf right side wall 206, and shelf top wall 208 surround shelf bottom wall 210 and rotatable shelf bottom wall 212 to form an enclosed shelf though this is not required in alternative embodiments though inclusion of shelf door 200 protects against items falling from shelf bottom wall 210 and rotatable shelf bottom wall 212 and from the lower door shelf when rotatable shelf bottom wall 212 is rotated upwards.

As used in this disclosure, the term "mount" is intended to define a structural connection between two or more elements and includes join, unite, connect, couple, associate, insert, hang, hold, affix, attach, fasten, bind, paste, secure, bolt, screw, rivet, solder, weld, glue, adhere, form over, layer, and other similar terms. The phrases "mounted on" and "mounted to" include any interior or exterior portion of the elements referenced. These phrases also encompass direct mounting (in which the referenced elements are in direct contact) and indirect mounting (in which the referenced elements are not in direct contact). Elements referenced as mounted to each other herein may further be integrally formed together, for example, using a molding process as understood by a person of skill in the art. As a result, elements described herein as being mounted to each other need not be discrete structural elements.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computer to implement the disclosed embodiments.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A shelf comprising:

a floor plate comprising a front edge, a right edge, a left edge, and a back edge, wherein the back edge is closest to a second wall when the floor plate is mounted adjacent the second wall, wherein the right edge extends between the front edge and the back edge, wherein the left edge extends between the front edge and the back edge;

a cam plate mounted to the floor plate to extend away from an upper surface of the floor plate, wherein a top edge of the cam plate is opposite a bottom edge of the cam plate that is mounted to the upper surface of the floor plate, wherein the top edge has a concave shape that curves inward toward the upper surface of the floor plate; and a first pin joint plate mounted to the floor plate to extend away from a lower surface of the floor plate, wherein the first pin joint plate is configured to mate with a second pin joint plate mounted to a first wall when the floor plate is mounted to the first wall, wherein the top edge of the cam plate is positioned to abut a tab mounted to the second wall when the floor plate is mounted adjacent the second wall and rotated toward the second wall, wherein the upper surface of the floor plate faces the second wall when the floor plate is rotated toward the second wall.

2. The shelf of claim 1, wherein the cam plate is mounted to the floor plate adjacent the back edge of the floor plate.

3. The shelf of claim 1, further comprising:

a second cam plate mounted to the floor plate to extend away from the upper surface of the floor plate, wherein a top edge of the second cam plate is opposite a bottom edge of the second cam plate that is mounted to the upper surface of the floor plate, wherein the top edge of the second cam plate has the concave shape that curves inward toward the upper surface of the floor plate.

4. The shelf of claim 3, wherein the cam plate is mounted to the floor plate adjacent a right corner defined where the right edge meets the back edge of the floor plate, and the second cam plate is mounted to the floor plate adjacent a left corner defined where the left edge meets the back edge of the floor plate.

5. The shelf of claim 3, wherein the top edge of the second cam plate is positioned to abut a second tab mounted to the second wall when the floor plate is mounted adjacent the second wall and rotated toward the second wall.

6. The shelf of claim 1, wherein the cam plate comprises a notch formed in the top edge of the cam plate, wherein the tab engages with the notch when the floor plate is rotated to extend in a direction that is approximately parallel to the second wall.

7. The shelf of claim 6, wherein the top edge of the cam plate is elongated to extend from the back edge of the floor plate to the front edge of the floor plate.

8. The shelf of claim 7, wherein the notch is formed in a front half of the top edge of the cam plate, wherein, relative to a center of the elongated top edge, the front half of the top edge is on a side of the center toward the front edge of the floor plate.

9. The shelf of claim 1, further comprising a handle mounted to the lower surface of the floor plate to extend away from the lower surface of the floor plate, wherein the handle is positioned closer to the front edge of the floor plate than the back edge of the floor plate.

10. The shelf of claim 1, wherein the cam plate is at least partially above the first pin joint plate when the floor plate is in a horizontal position.

11. The shelf of claim 10, wherein the cam plate is centered above the first pin joint plate in a direction from the front edge of the floor plate to the back edge of the floor plate.

12. The shelf of claim 1, further comprising:

the first wall; and the second wall is a back wall of the shelf, wherein the second wall is approximately perpendicular to the first wall.

13. The shelf of claim 12, wherein the tab is formed by two apertures formed through the second wall along a lower edge of the second wall.

14. The shelf of claim 12, wherein the first wall is a bottom wall that extends parallel to the floor plate when the floor plate is in a horizontal position, wherein the second pin joint plate is mounted to the first wall to extend away from an upper surface of the first wall.

15. The shelf of claim 14, wherein the first pin joint plate includes a pin that protrudes approximately perpendicularly from the first pin joint plate, wherein the second pin joint plate includes an aperture formed at least partially through the second pin joint plate, wherein the pin is mounted within the aperture when the floor plate is mounted to the first wall.

16. The shelf of claim 14, wherein, when the floor plate is mounted to the first wall, the first wall includes a shelf that extends away from a side edge of the first wall toward the floor plate, and a portion of the lower surface of the floor plate rests on the shelf.

17. The shelf of claim 12, further comprising:

a top wall mounted to the second wall to extend over the floor plate and the first wall.

18. The shelf of claim 17, further comprising:

a right side wall mounted adjacent a right end of the top wall and the second wall;

a left side wall mounted adjacent a left end of the top wall and the second wall; and a shelf door mounted between the right side wall and the left side wall, wherein the shelf door is configured to open.

19. A door comprising:

an interior door plate;

a right mounting ladder mounted to the interior door plate;

a left mounting ladder mounted to the interior door plate;

a shelf mounted to the right mounting ladder and to the left mounting ladder; and a rotatable shelf mounted to the right mounting ladder and to the left mounting ladder above the shelf, the rotatable shelf comprising a floor plate comprising a front edge, a right edge, a left edge, and a back edge, wherein the back edge is closest to a second wall when the floor plate is mounted adjacent the second wall, wherein the right edge extends between the front edge and the back edge, wherein the left edge extends between the front edge and the back edge;

a cam plate mounted to the floor plate to extend away from an upper surface of the floor plate, wherein a top edge of the cam plate is opposite a bottom edge of the cam plate that is mounted to the upper surface of the floor plate, wherein the top edge has a concave shape that curves inward toward the upper surface of the floor plate; and a first pin joint plate mounted to the floor plate to extend away from a lower surface of the floor plate, wherein the first pin joint plate is configured to mate with a second pin joint plate mounted to a first wall when the floor plate is mounted to the first wall, wherein the top edge of the cam plate is positioned to abut a tab mounted to the second wall when the floor plate is mounted adjacent the second wall and rotated toward the second wall, wherein the upper surface of the floor plate faces the second wall when the floor plate is rotated toward the second wall.

20. A refrigerator comprising:

a refrigeration system;

a compartment comprising a plurality of walls; and a door configured to provide access to an enclosed space defined by the plurality of walls and the door;

a right mounting ladder mounted to the door;

a left mounting ladder mounted to the door;

a shelf mounted to the right mounting ladder and to the left mounting ladder; and a rotatable shelf mounted to the right mounting ladder and to the left mounting ladder above the shelf, the rotatable shelf comprising a floor plate comprising a front edge, a right edge, a left edge, and a back edge, wherein the back edge is closest to a second wall when the floor plate is mounted adjacent the second wall, wherein the right edge extends between the front edge and the back edge, wherein the left edge extends between the front edge and the back edge;

a cam plate mounted to the floor plate to extend away from an upper surface of the floor plate, wherein a top edge of the cam plate is opposite a bottom edge of the cam plate that is mounted to the upper surface of the floor plate, wherein the top edge has a concave shape that curves inward toward the upper surface of the floor plate; and a first pin joint plate mounted to the floor plate to extend away from a lower surface of the floor plate, wherein the first pin joint plate is configured to mate with a second pin joint plate mounted to a first wall when the floor plate is mounted to the first wall, wherein the top edge of the cam plate is positioned to abut a tab mounted to the second wall when the floor plate is mounted adjacent the second wall and rotated toward the second wall, wherein the upper surface of the floor plate faces the second wall when the floor plate is rotated toward the second wall.

* * * * *